US005784467A

United States Patent [19]

Asayama

[11] Patent Number: 5,784,467

[45] Date of Patent: Jul. 21, 1998

[54] METHOD AND APPARATUS FOR REPRODUCING THREE-DIMENSIONAL VIRTUAL SPACE SOUND

[75] Inventor: Hiroshi Asayama, Tokyo, Japan

[73] Assignee: Kabushiki Kaisha Timeware, Tokyo, Japan

[21] Appl. No.: 626,632

[22] Filed: Apr. 1, 1996

[30] Foreign Application Priority Data

Mar. 30, 1995 [JP] Japan ..... 7-073658

[51] Int. Cl.[6] ..... H04R 5/00

[52] U.S. Cl. ..... 381/17; 381/18; 381/63

[58] Field of Search ..... 381/17, 18, 61, 381/63, 1

[56] References Cited

U.S. PATENT DOCUMENTS 5,105,462 4/1992 Lowe et al. ..... 381/17

5,467,401 11/1995 Nagamitsu et al. ..... 381/17

5,517,570 5/1996 Taylor ..... 381/18

*Primary Examiner*—Curtis A. Kuntz

*Assistant Examiner*—Ping W. Lee

*Attorney, Agent, or Firm*—Kane, Dalsimer, Sullivan, Kurucz, Levy, Eisele and Richard, LLP

[57] ABSTRACT

In the method and apparatus for obtaining acoustic characteristics of sound of a broad frequency range of from, for example, 0 to 20 KHz in a relatively short time with high accuracy even though an inexpensive computer is used; multiple sound ray vectors are defined; a virtual space is defined by a polygonal boundary; the propagation history data of the vector is calculated and stored, the vector being reflected at the boundary; and, based on the data, as for each of the vectors, a transient response thereof at an observation point is added to a time-series numerical array and stored, the response being determined on the basis of the reflected vector and a velocity potential determined at the observation point by a micro-area element of the vector defined on the boundary.

18 Claims, 27 Drawing Sheets

EXAMPLE OF A VIRTUAL WINDOW SANDWICHED BETWEEN VIRTUAL SPACE AND REAL SPACE

EXAMPLE IN WHICH THE LOUD SPEAKERS FORMING THE VIRTUAL WINDOWS ARE HIDDEN BY A SCREEN PERMEABLE TO SOUND. THE SCREEN MAY SERVE AS A PICTURE-DISPLAY SCREEN

VIRTUAL WINDOW CONSTRUCTED OF 96 PIECES OF THE LOUD SPEAKERS SERVING AS THE ACOUSTIC GENERATORS

SUM OF PRODUCTS CALCULATOR WITH 24 CHANNELS

RESPONSE OBTAINED USING A CONVENTIONAL ORTHODOX CALCULUS (VIRTUAL IMAGE METHOD)

IMPULSE RESPONSE OBTAINED USING THE CALCULATING PROCEDURE OF THE PRESENT INVENTION

METHOD AND APPARATUS FOR REPRODUCING THREE-DIMENSIONAL VIRTUAL SPACE SOUND

BACKGROUND OF THE INVENTION

1. Field of the Invention

The present invention relates to a practicable method and apparatus for reproducing acoustic characteristics of sound waves which are issued from a sound source and propagated to an arbitrary point in a three-dimensional virtual space, the acoustic characteristic appearing at the arbitrary point. More particularly, the present invention relates to a method and apparatus for enabling a sound having been reproduced at a predetermined point in the virtual space to reappear in an existing real space. Further, the present invention relates to a sound-field synthesis method and apparatus for very precise reproduction of a sound field in real space.

2. Description of the Prior Art

Many types of methods for simulating wave motion propagation such as sound waves and the like propagated in a three-dimensional arbitrary space have been previously researched. For example, there are many conventional wide-use calculuses such as the sound-ray method, virtual-image method and the like based on the orthodox geometrical acoustics. However, these calculuses in that they ignore wave characteristics of sound and phase information in the calculation results, to cause a considerably large calculation errors. On the other hand, there are some calculuses which consider wave characteristics of a sound, such as the finite element method, the boundary element method and the like. However, such calculuses are also have drawbacks in that it is very difficult to calculate a transient response; and, a very large volume of calculation is required to obtain calculation results for audio frequency bands with a high frequencies such as 16 KHz, and the like. These facts make it very difficult even for current super computers to obtain calculation results.

As for the above problems, the inventor of the present invention previously proposed an approximate calculus (hereinafter referred to as the approximate boundary integral method) which takes into account the wave characteristics by using a modification of Kirchhoff's integral equation as its basic theoretical formula, the Kirchhoff integral equation being known as one of integral representations of three-dimensional inhomogeneous wave equations. This approximate boundary integral has been clearly proved to be capable of realizing a very close approximation to acoustic characteristics propagated in a three-dimensional space. On the other hand, sound waves propagated in the space act as waves and to propagate in all directions in the space, and are absorbed by wall surfaces defining the space or reflected at the surfaces. The sound waves thus reflected further, and propagate in all directions in the space. In order to perform an acoustic analysis of such sound waves, the approximate boundary integral may be used. However, even by the use of this approximate boundary integral, a very large volume of wave calculation as is in infinite series is still required.

SUMMARY OF THE INVENTION

It is an object of the present invention to provide a processing method and apparatus for reproducing acoustic characteristics of sound waves propagated in a three-dimensional space, which method and apparatus: use the Kirchhoff integral or the approximate boundary integral; are free from the above-mentioned problems and excellent in accuracy and practicable; further minimize a software's static/dynamic size; and, enable even an inexpensive computer to calculate with high accuracy the acoustic characteristic of sound waves having a wide frequency band, for example, from 0 to 20 KHz in a relatively short time, without using a high-speed and expensive electronic computer such as super computers and the like.

It is another object of the present invention to provide a method and apparatus for actually reproducing acoustic characteristics of sound waves in an existing real space, the sound waves being issued from a sound source, propagated in a virtual space different from the real space, and affecting a desired position of the virtual space.

According to a first aspect of the present invention, the above objects of the present invention are accomplished by providing:

A method for reproducing a three-dimensional virtual space sound appearing at an arbitrary point in a virtual space defined by a plurality of boundaries, the sound being issued from at least one sound source and propagated in the space, the improvement wherein:

sound waves radiating from a wave source are represented by a plurality of sound ray vectors; of the boundaries intersecting with the sound ray vector, as for one, which is within a distance that the sound waves travel in a predetermined period of time, upon which the sound ray vector is incident, and at which the sound ray vector is reflected, a propagation history data of each of the sound ray vectors is stored, the propagation history data comprising the incident sound ray vector, the reflected sound ray vector, a total propagation distance between the wave source and one of the boundaries, and coordinates of the intersection at which the sound ray vector intersects with the one of boundaries; and acoustic characteristics of the sound appearing at the observation point are determined on the basis of both the stored propagation history data and a micro-area of the one of boundaries occupied by the sound ray vector corresponding to the propagation history data.

According to a second aspect of the present invention, the above objects are accomplished by providing:

A method for reproducing the three-dimensional virtual space sound, as set forth in the first aspect of the present invention, wherein:

the acoustic characteristics of the sound affecting the observation point at predetermined time intervals are added to a time-series numerical array corresponding to the predetermined time intervals and stored, so that a transient response of the sound appearing at the observation point is determined.

According to a third aspect of the present invention, the above objects of the present invention are accomplished by providing:

A method for reproducing the three-dimensional virtual space sound, as set forth in the second aspect of the present invention, wherein:

a plurality of loud speakers for reproducing the virtual space sound in a real space are arranged in a system;

in accordance with positions of the loud speakers, a plurality of sound directions in which the sound waves reach a listener are defined in the system; and the transient response of the sound is determined as to each of the plurality of sound directions thus defined.

According to a fourth aspect of the present invention, the above objects of the present invention are accomplished by providing:

A method for reproducing the three-dimensional virtual space sound, as set forth in the third aspect of the present invention, wherein:

in the system for reproducing the virtual space sound in the real space, the transient response of the sound is determined as to each of combinations of (at least multiple one) sound source(s) and the sound directions thus defined.

According to a further aspect of the present invention, the above objects of the present invention are accomplished by providing:

The method for reproducing the three-dimensional virtual space sound, as set forth in the fourth aspect of the present invention, wherein:

the transient response of the sound corresponding to the loud speakers is reproduced by the use of a sum-of-products calculator so as to reproduce a sound field at the observation point in real space.

Further, the present invention introduces the concept of virtual windows to realize a method and apparatus for reproducing sound with high accuracy, and also to realize a method and apparatus of synthesis of acoustic characteristics of a sound, as follows. Namely, in the method and apparatus of the present invention for reproducing three-dimensional virtual space sounds: a closed space which surrounds an observation point, or a wall surface from which the observation point is oppositely disposed is provided; the closed space or the wall surface is divided into a plurality of areas which are virtual windows; and, acoustic characteristics of the sound is determined at each of the virtual windows. In order to realize the virtual space sound in a real space, in the method and apparatus of the present invention: (a multiple of) loud speakers are disposed in positions corresponding to the virtual windows; and, the acoustic characteristics of the sound having been determined at each of the virtual windows are reproduced by each of the loud speaker thus disposed. In other words, the acoustic characteristic thus determined are reproduced by each of the corresponding loud speakers so that synthesis of a sound field at the observation point is realized, whereby the sound-field synthesis method and apparatus of the present invention are provided.

BRIEF DESCRIPTION OF THE DRAWINGS

FIG. 2 including

FIG. 3 including

DESCRIPTION OF THE PREFERRED EMBODIMENTS

Hereinbelow, the present invention will be described in detail with reference to the accompanying drawings.

First of all, in order to facilitate the description of the present invention, the Kirchhoff integral and a so-called approximate-boundary integral will be described. Then, the present invention will be clarified.

The Kirchhoff integral equation (i.e., equation 2) is derived from three-dimensional wave equation (i.e., equation 1). A modified integral equation (i.e., equation 3) of the equation 2 is called the approximate-boundary integral equation.

Figure 26:
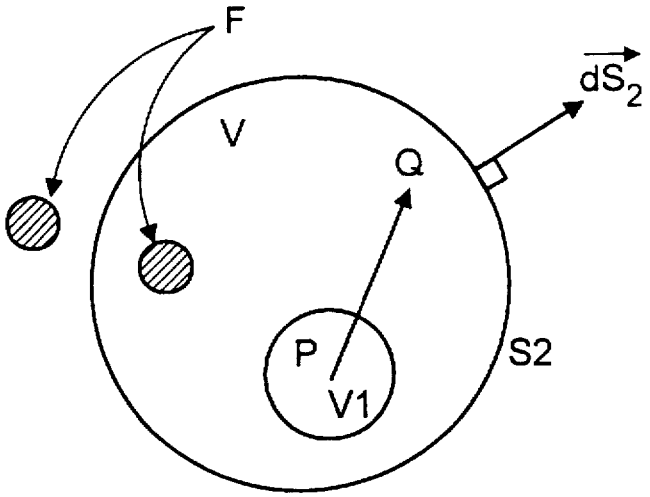
FIG. 26 is an arbitrary space, for illustrating the concept of the Kirchhoff integral equation and called the approximate-boundary integral equation.

With reference to FIG. 26, the three-dimensional wave equation (i.e., equation 1) is represented as follows:

$$\nabla^2\phi - \frac{1}{C^2}\frac{\partial^2\phi}{\partial t^2} = -F(x, y, z, t)$$

where: x, y and z are three-dimensional coordinates; C is the sound velocity; t is the time; F is a wave source; and $\phi$ is the velocity potential where: S2 is the surface defining an arbitrary space; Q is an arbitrary point on the S2; P is the observation point for determining the transient response; V is an area except an area V1 in the vicinity of the observation point P; F is the wave source; $dS_2$ is a micro-area vector on the S2

Equation 2 is an integral of three-dimensional wave equation (i.e., equation 1) to represent the velocity potential at the observation point P, and is represented as follows:

$$\phi_p = \frac{1}{4\pi}\int_V \frac{1}{r}[F]_{t_d}dv + \frac{1}{4\pi}\int_{S_2}\left[\frac{1}{r}[\nabla_Q\phi]_{t_d} - [\phi]_{t_d}\nabla_Q\frac{1}{r} + \frac{1}{cr}\left[\frac{\partial\phi}{\partial t}\right]_{t_d}\nabla r\right]d\vec{s_2}$$

where: $\phi p$ is the velocity potential at the observation point P; [ ] td is the delay time t−r/e; V is an arbitrary space surrounding the observation point P; S2 is the surface of the V; Q is an arbitrary point on the S2; and, r is the distance between the Q and the observation point P.

The modification of the integral of Kirchhoff's equation (i.e., the approximate-boundary integral equation 3) is represented as follows:

$$\phi_p = \frac{1}{d}f\left[t - \frac{d}{C}\right] + \frac{1}{4\pi}\int_{S_2}\left[\frac{1}{Crr_o}\frac{\partial}{\partial t}f\left[t - \frac{r_o}{C}\right][\cos(\vec{r}, \vec{n}) - \cos(\vec{r_o}, \vec{n})] + \frac{1}{rr_o}f\left[t - \frac{r_o}{C}\right]\left[\frac{1}{r}\cos(\vec{r}, \vec{n}) - \frac{1}{r_o}\cos(\vec{r_o}, \vec{n})\right]\right]dS_2$$

where: $\phi p$ is the velocity potential at the observation point P; [ ] td is the delay time t−r/e; V is an arbitrary space surrounding the observation point P; S2 is the surface of the V; Q is an arbitrary point on the S2; r is the distance between the Q and the observation point P; and, $r_o$ is a total distance between the wave source and the Q.

The function f(t) represents a transient signal of a sound produced at the wave source.

(EMBODIMENT 1 OF THE INVENTION)

Now, the processing procedure of the present invention will be described with reference to its embodiment. In the embodiment, although the present invention is described by the use of the approximate-boundary integral equation, it is also possible to describe the present invention by the use of any other suitable equation, provided that such other equation may determine the velocity potential of a sound as is in the Kirchhoff integral equation, three-dimensional wave equation and the like.

Flowcharts shown in FIGS. 1 to 4 facilitate the description of the embodiment of the present invention.

Figure 1:
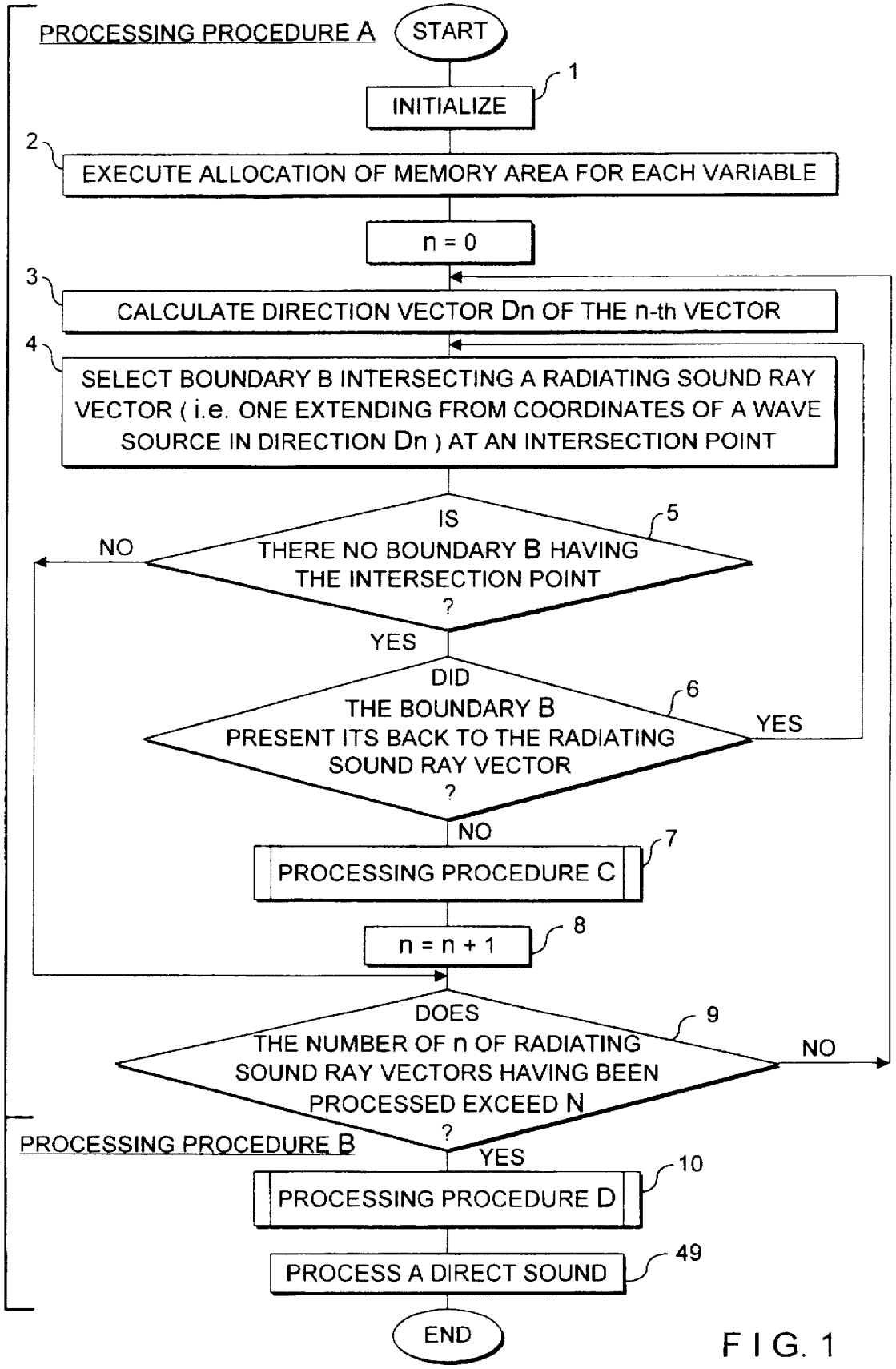
FIG. 1 is a flowchart illustrating the entire of a processing procedure of the present invention.

In these flowcharts, steps of the processing procedures are denoted by sequential reference numerals starting from the number of "1". FIG. 1 shows the entire of the processing procedure ranging from the start to the end of the procedure, and is divided into two essential parts: "processing procedure A" and "processing procedure B".

Figure 2A:
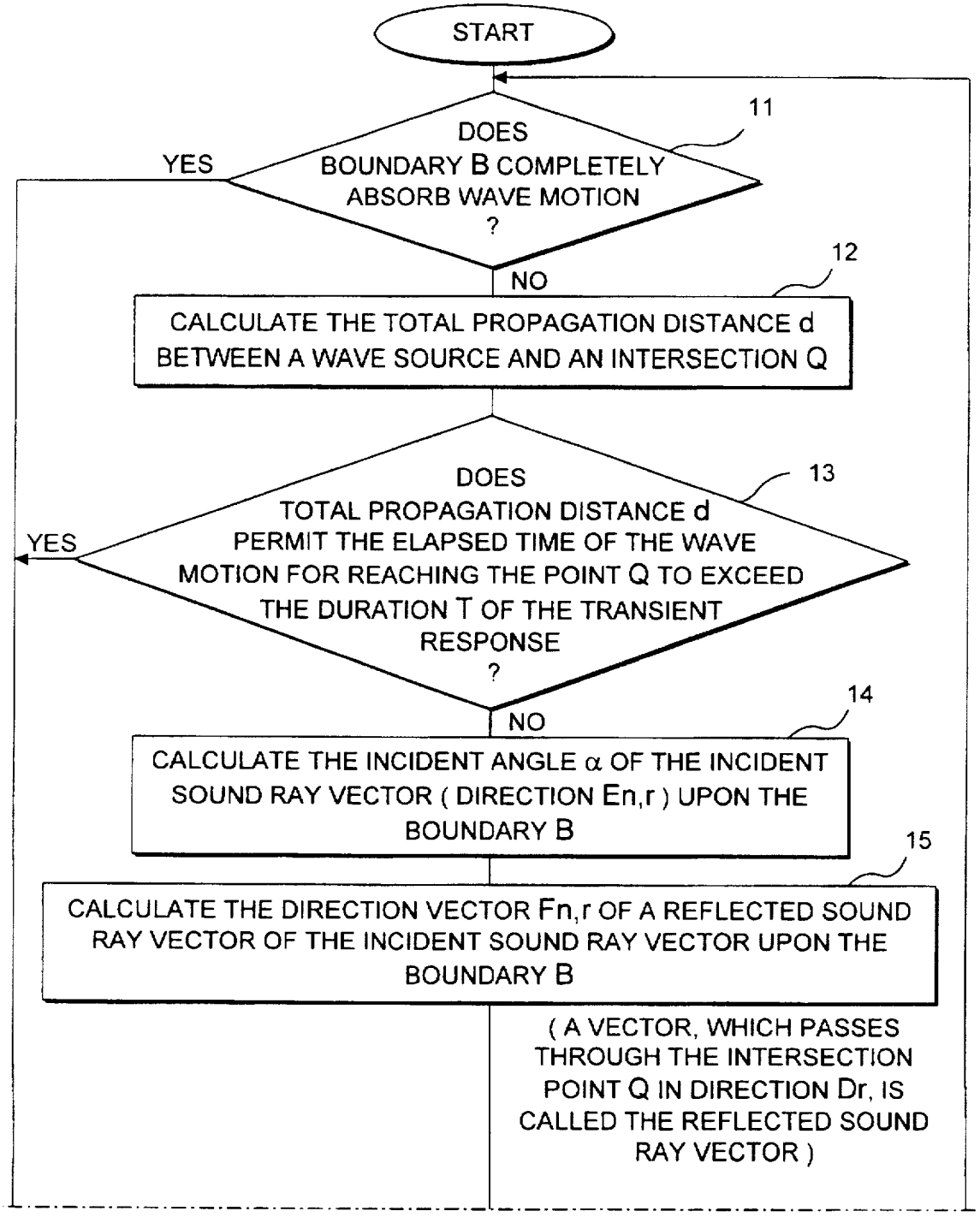
FIGS. 2A and 2B is a flowchart illustrating a processing procedure "C" of FIG. 1 for determining the propagation history and storing the same.
Figure 2B:
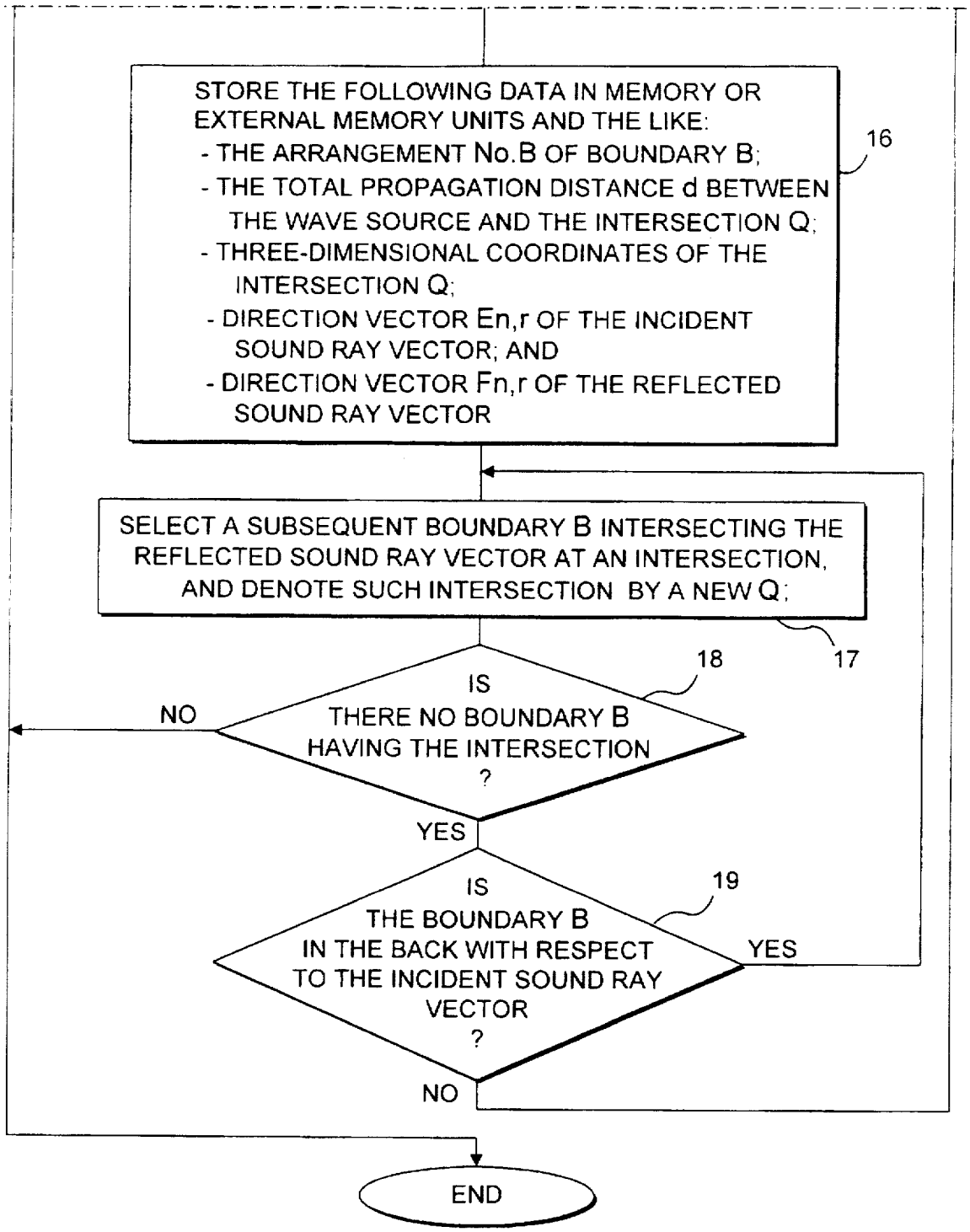

A step 7, i.e., processing procedure "C" shown in FIG. 1 corresponds to a processing procedure shown in FIG. 2. On the other hand, processing procedure "D" shown in FIG. 1 corresponds to a processing procedure shown in FIG. 3. Further, processing procedure "E" shown in FIG. 3 corresponds to a processing procedure shown in FIG. 4.

As shown in FIG. 1, in a first step 1 "initialize", performed as prerequisite for executing the processing procedure are "setting of calculation conditions", "setting of wave-source conditions", "setting of a boundary", and "setting of wave-source radiating sound ray vectors".

Set in the "setting of calculation conditions" are: three-dimensional coordinates of the wave source; the number of observation points; three-dimensional coordinates of each of the observation points; the temperature and moisture of the air in the space; an analytic frequency (i.e., the highest frequency in the transient response to be calculated); the duration time, T of the transient response to be calculated; and, the like. Such setting is performed by means of an input unit through which a user inputs necessary data, or by means of an external memory unit from which the necessary data is retrieved.

In the "setting of wave-source conditions", an initial value of the sound issued from the sound source is represented to be a transient signal by the use of a delta approximate function and its derivative, which resembles an impulse in shape. Such initial value may be modified if necessary in application.

Further, propagation velocity of the sound is calculated based on the temperature and moisture of the air set in step 1. Based on the analytic frequency, a discrete-time interval, which corresponds to a frequency of equal to or over twice as high as the analytic frequency, is set according to Shanon's sampling theorem. A size of memory area for storing therein the transient response to be calculated, which is used in the "processing procedure B", is determined on the basis of both the duration time of the transient response and the discrete-time interval.

In the "setting of a boundary", information as to the boundary defining a sound field is set. This represents a numerical space for simulating wave-motion propagation of the sound therein, and constructed of a plurality of polygons in plane. In this "setting of a boundary", each of the polygons is called the boundary. Set in the "setting of a boundary" are: the number of the boundaries; a normal, i.e., perpendicular line of each of the boundaries; coordinates of each vertex in each of the boundaries; reflection and absorption at the boundaries; and, the like. Incidentally, in the following description of the embodiment of the present invention, in order to facilitate the description, it is assumed that each of the boundaries only performs total reflection and total absorption of the sound over the entire frequency band.

In the "setting of wave-source radiating sound ray vectors", the number of sound ray vectors, N, radiating from the wave source are calculated. In this setting, the wave motion of the sound propagated from the wave source is simulated to calculate both a position and a time at which the wave motion is reflected at the boundary, so that acoustic characteristics (i.e., velocity potential "$\phi p$") of the sound at the observation point are calculated. Such simulation of the wave motion propagation of the sound is performed by the use of numerous vectors, each of which has the same solid angle and radiates from the wave source in the space. Such vectors are defined as sound ray vectors in the present invention. The number N of the radiating sound ray vectors is set so as to let the distance between adjacent sound ray vectors be equal to or smaller than ½, preferably ¼ of a wave length "$\lambda$" of the analytic frequency. The length between adjacent sound ray vectors depends on the capacity of processing units and the degree of approximation in the reproduction of the sound, and, therefore may be more than ½ of the "$\lambda$" in some cases. Incidentally, vectors representing the wave surface of the sound propagated in the space, are generally called the sound ray vectors. Of these sound ray vectors, ones radiating from the wave source are especially called the radiating sound ray vectors.

In step 3, the wave motion propagated from the wave source is simulated with the use of the sound ray vectors. Namely, first of all, a direction vector Dn of the n'th radiating sound ray vector is calculated so as to have directions of N pieces of the radiating sound ray vectors form the same solid angles therebetween with respect to the wave source.

Selected in step 4 following step 3 is the boundary B having an intersection at which it intersects the sound ray vectors propagated from the sound source. In step 5 following step 4, when there is no boundary intersecting with the sound ray vectors, calculation is performed as to a subsequent one of the radiating sound ray vectors.

On the other hand, when there is some boundary having the intersection, the sound ray vector is reflected at the boundary B. In this case, it is necessary to judge whether the boundary showed its front or its back to the sound ray vector.

Such judgment may be accomplished by determining whether an angle formed between a normal, i.e., perpendicular line of the boundary and the sound ray vector is within an angle range of from 0 to 180 degrees. In other words, in case that the normal vector of the boundary is so defined as to extend outward in a virtual space, when the angle formed between the normal boundary and the radiating sound ray vector is within the angle range of from 0 to 180 degrees (i.e., when an inner product thereof is positive), the boundary is defined to be the front. Otherwise (i.e., when the angle is within an angle range of from 180 to 360 degrees), the boundary is defined to be the back. The reason why the angle is defined in a manner described above is that it is necessary for the computer to judge in operation: whether the sound ray vector is issued from the inside of the boundary toward the front side thereof (i.e., whether or not the sound ray vector is reflected at the boundary); or, whether the sound ray vector is issued from the outside of the boundary toward the back side thereof (i.e., whether or not the sound ray vector merely passes through the boundary without being reflected thereby).

According to the above definitions, in step 6 following step 5, when the boundary B is to the back of the sound ray vector, it is necessary to select any other boundary having the above-described intersection. On the other hand, when the boundary B is, in front of to the sound ray vector, step 6 is followed by step 7, i.e., processing procedure "C".

In step 7, i.e., processing procedure "C", when the boundary B is set so as to completely absorb the wave motion of the sound in step 11, the processing procedure goes to "End", as shown in FIG. 2. Otherwise, step 11 is followed by a subsequent step 12 in which the total propagation distance d between the wave source and the intersection Q of the boundary B is calculated. Step 12 is followed by a subsequent step 13. In step 13, when the thus calculated propagation distance d is one permitting the elapsed time of the wave motion for reaching the point Q to exceed the duration time of transient response, step 13 is followed by "End", as shown in FIG. 2. Although these steps 11, 12 and 13 may be interchangeable in processing order, the processing order shown in FIG. 2 is the best in efficiency to minimize the processing time.

Otherwise, i.e., in step 13, when the propagation distance d is not such one, step 13 is followed by a subsequent step 14 in which an incident angle "$\alpha$" of the sound ray vector incident upon the boundary B is calculated to determine the incident angle formed between the incident sound ray vector and the normal (i.e., perpendicular line) of the boundary plane in the above-described equation 3. The incident sound ray vector is defined as one which is the n'th radiating sound ray vector reaching the boundary B. On the other hand, the incident sound ray vector incident upon the boundaries "r" times is defined as "En, r". Consequently, the "En, r" is the radiating sound ray vector which is issued from the wave source to reach the r'th boundary B.

Then, step 14 is followed by a subsequent step 15. Calculated in the step 15 is the direction vector of the reflected one of this incident sound ray vector, the reflected one being reflected at the intersection Q. The reflected sound ray vector is defined to be one which is the n'th radiating sound ray vector Dn having been reflected at the boundary B and is found there. Of the reflected sound ray vectors, one having been reflected at the boundaries "r" times is defined as "Fn, r". Consequently, the "Fn, 1" is the n'th sound ray vector having been reflected at the boundary for the first time.

Step 15 is followed by a subsequent step 16. Stored in the main memory or an external memory unit in step 16 are: arrangement No. B of the boundary; total propagation distance "d" between the wave source and the intersection Q; three-dimensional coordinates of the intersection Q; the direction vector "En, r" of the incident sound ray vector;

and, the direction vector "Fn, r" of the reflected sound ray vector. A series of data calculated each time the radiating sound ray vector Dn is reflected at the boundary is defined as the propagation history of the radiating sound ray vector Dn. The reason why the propagation history is stored in the memory is because it is necessary to calculate the velocity potential of the sound ray vector, which potential affects the observation point P each time the sound ray vector is reflected at the arbitrary point of the boundary surface S2 (shown in the above equation 3). The total propagation distance "d" above described corresponds to the "$r_o$" of equation 3.

Step 16 is followed by a subsequent step 17. Selected in step 17 is another or subsequent one of the boundaries B having a new intersection Q at which such another one intersects with the reflected sound ray vector having the direction "Fn, r". Step 17 is followed by a subsequent step 18. When there is no boundary B having the intersection Q, the processing procedure goes to "End", as shown in FIG. 2. When there is any other boundary having such intersection Q, the step 18 is followed by a subsequent step 19. In step 19, when the incident sound ray vector having the intersection Q is incident on the back side of the boundary B, it is necessary to find another boundary B having the intersection Q. When the incident sound ray vector having the intersection Q is incident on the front side of the thus found other boundary B, step 19 is followed by step 11 to repeat the above-described processing procedure.

After completion of the processing procedure "C" with respect to the n'th radiating sound ray vector, as is clear from FIG. 1, the same processing procedure is repeated for each of the subsequent radiating sound ray vectors. Namely, after completion of the processing procedures as to all the radiating sound ray vectors, the processing procedure "C" is followed by a subsequent processing procedure "B".

In summary, the processing procedure "A" comprising of the series of steps 1 to 9 is performed to calculate and store the propagation histories of all the sound ray vectors.

As is clear from the above description, an apparatus for performing the processing procedure "A" comprises: a means for storing the initialization data; a means for calculating or determining the propagation record data; and, a means for storing the propagation record data.

On the other hand, as is clear from FIG. 3, calculation performed in the subsequent processing procedure "D" is based on the propagation histories of n pieces of the radiating sound ray vectors, as follows:

Namely, the processing procedure "D" starts with step 21. In step 21, coordinates of the first observation point P for calculating the transient response are retrieved from memory and the like. First, data as to the propagation history of the radiating sound ray vector of "n=0" is retrieved in step 22 following step 21. As for a first one of the boundaries B in the thus retrieved propagation history, when this one has its back side faced to the observation point P, subsequent propagation histories retrieved in step 32 to continue the processing procedure. On the other hand, when such boundary B has its front side faced to the observation point P, the processing procedure goes to step 25 in which a direction vector R extending from the observation point P toward the intersection Q recorded in the propagation history is calculated. Step 25 is followed by a subsequent step 26 in which the distance RD between the observation point P and the intersection Q is calculated. Step 26 is followed by a subsequent step 27 in which when a straight line connecting the observation point P with the intersection Q intersects with the remaining one of the boundaries, it is judged that the velocity potential from the intersection Q does not affect the observation point P. As a result, the processing procedure goes to step 32. On the other hand, in step 27, when the straight line connecting the observation point P with the intersection Q does not intersect with any other boundaries, step 27 is followed by a subsequent step 28, and therein it is judged whether the wave motion reaches the observation point P within a period of time T. When it is judged that the wave motion reaches the observation point P within the period of time T, then the velocity potential on the boundary B affects the observation point P, and therefore step 28 is followed by the processing procedure "E". Incidentally, the above judgment is formed depending on whether the wave motion travels a predetermined distance within the duration time T of the initialized transient response, the predetermined distance being the sum of the total propagation distance d (i.e., that between the wave source and the intersection Q) and the distance RD.

Figure 4:
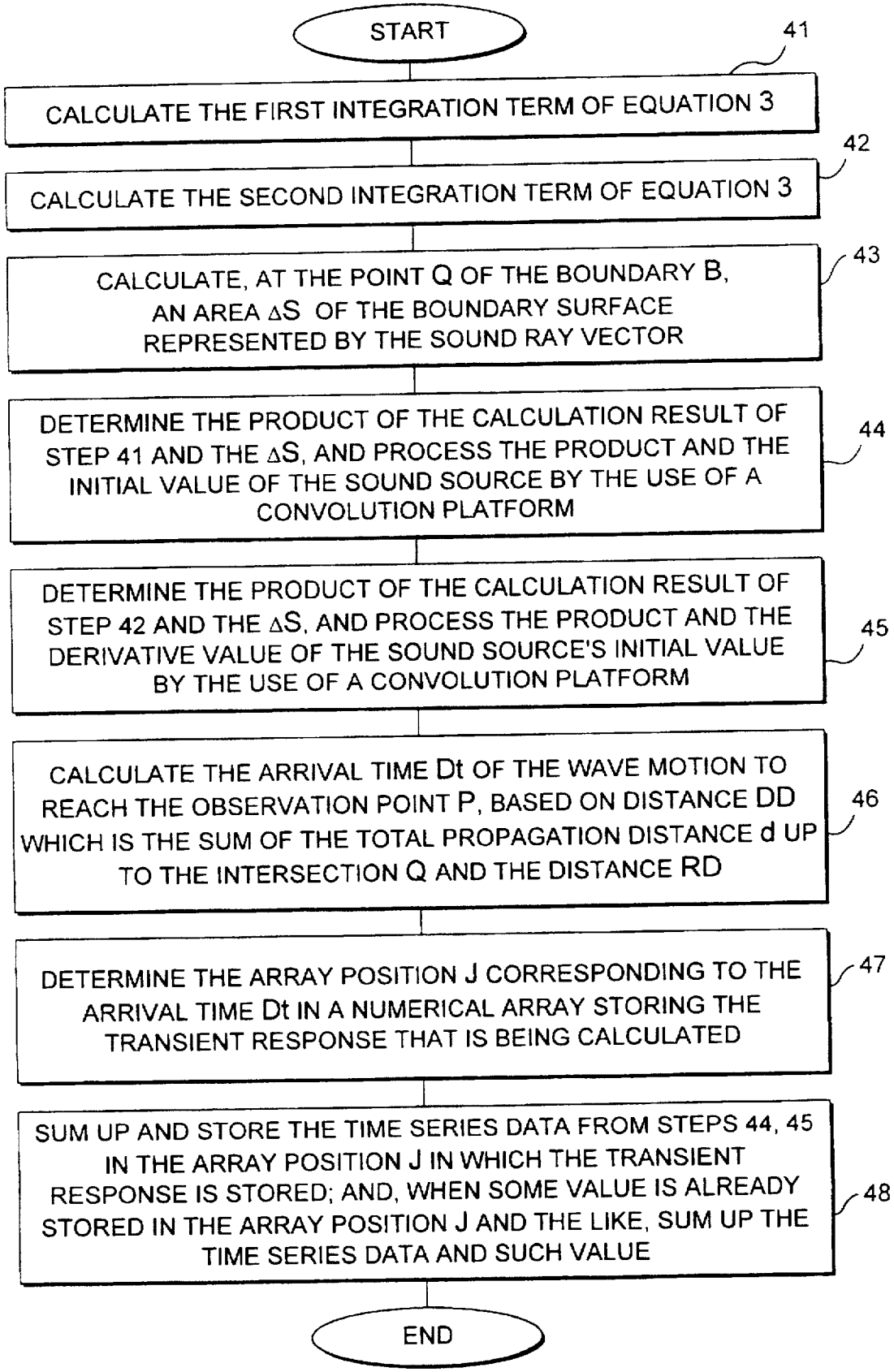
FIG. 4 is a flowchart of a processing procedure for calculating, adding and storing the transient response by the use of the approximate boundary integral.
Figure 5A:
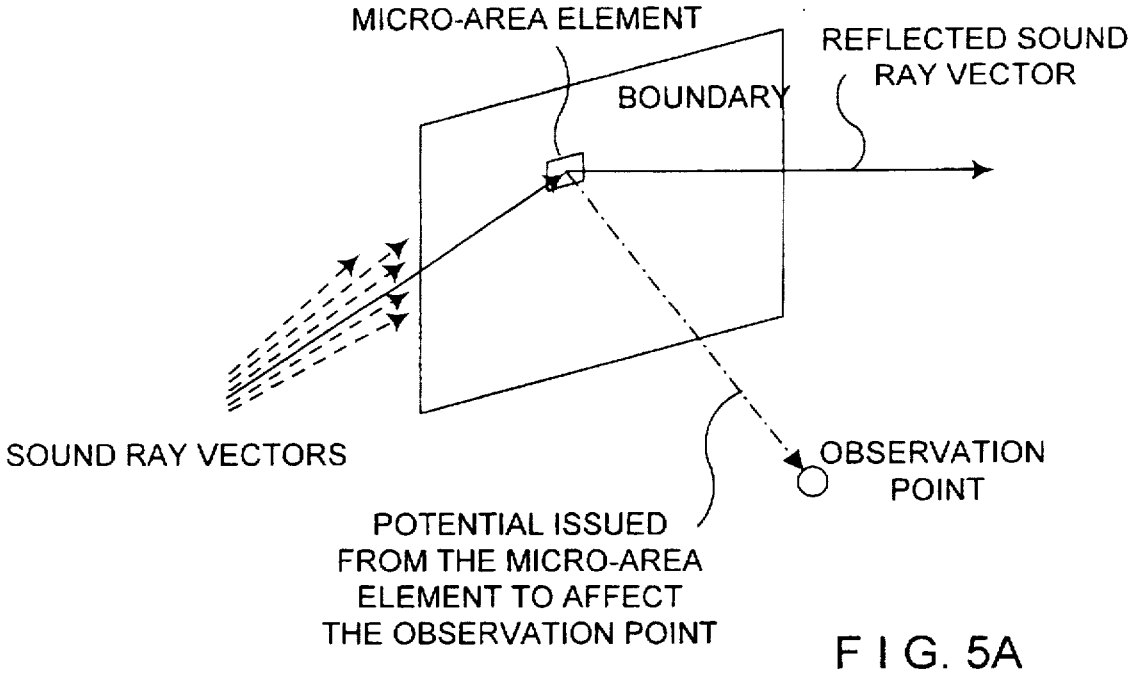
FIG. 5(A) is a perspective view of the boundary, illustrating a micro-area element and its area size defined by the sound ray vector.
Figure 5B:
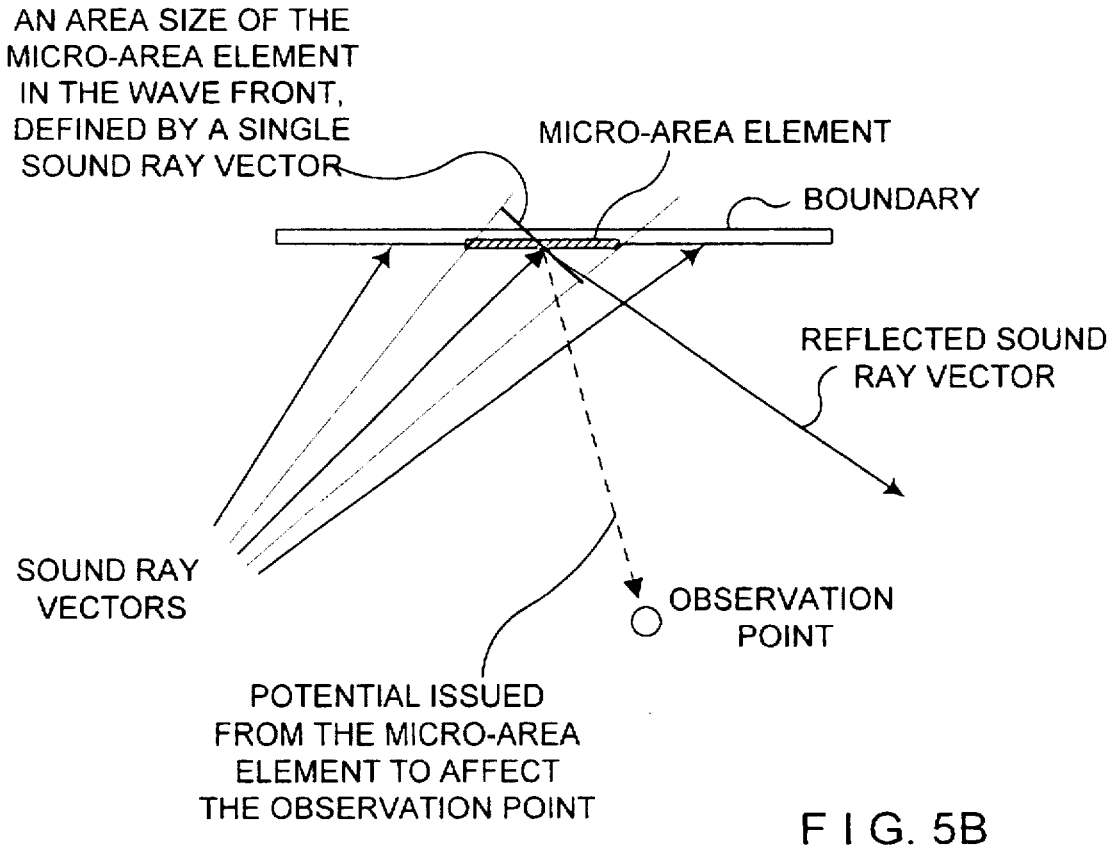
FIG. 5(B) is a plan view of the boundary, illustrating the micro-area element and its area size defined by the sound ray vector.

As shown in FIG. 4, in the processing procedure "E": the velocity potential, which is formed by a so-called micro-area element of the boundary represented by the intersection Q and affects the observation point P, is calculated by the use of the equation 3; and, based on a time at which the velocity potential affects the observation point P, the transient response is stored in array. When some data has been already stored in the same location of array, the transient response is added to the data. More particularly, the micro-area element is so defined as to be an area formed in the intersection Q by a solid angle used in the definition of the sound ray vector. In FIG. 5(A), a plurality of the sound ray vectors are issued toward the boundary, and one (shown in solid line) of such sound ray vectors forms the micro-area element on the boundary. In FIG. 5(B), is a plan view of the micro-area element formed on the boundary. As is clear from these drawings, the micro-area element on the boundary varies in size and determined by an angle formed between the sound ray vector and the boundary plane. More particularly, in data processing, the area size of the micro-area element on the boundary may be equal to that of a bottom area of a cone defined by both the total distance d from the wave source to the intersection Q and the solid angle described above. In this case, although approximation slightly becomes poor in accuracy, it is sufficient in practice. Further, in this case, since the area size of the micro-area element can be determined on the basis of only both the distance d and the solid angle, it is possible to increase the operation speed in data processing. Incidentally, this area size of the micro-area element corresponds to the term "dS2" of the equation 3.

As is clear from FIG. 4, the processing procedure starts with step 41 in which the first term of the integration term of equation 3 is calculated. Step 41 is followed by a subsequent step 42 in which the second term of the integration term of equation 3 is calculated. In calculation in the embodiment of the present invention, since the reflection and the absorption of a sound in the boundary are defined to be the total reflection and the total absorption only, the function f(t) used in the calculation may be defined as to be equal to the initialized transient function of the wave source. When each of the reflection and the absorption are a partial one, the function f(t) corresponding to the properties of the boundary may be determined as to the propagation history "Fn, r" each time the sound ray vector is reflected at the boundary.

Step 42 is followed by a subsequent step 43 in which the area size of the micro-area on the boundary is calculated to determine the integral approximation.

Step 43 is followed by a subsequent step 44 in which: a product of the calculation result obtained in step 41 and the area size of the micro-area element on the boundary obtained in step 43 is determined; and, the thus determined product and the initial value of the wave source are processed by the use of a calculus of convolution transformation.

Step 44 is followed by a subsequent step 45 in which: a product of the calculation result obtained in step 42 and the area size of the micro-area element on the boundary obtained in step 43 is determined; and, the thus determined product and the derivative value of the wave source's initial value are processed by the use of the calculus of convolution transformation.

In steps 46 to 48 following the step 45, the transient response base on the integral result of the approximate boundary is stored in the memory and the like. In order to reproduce the acoustic characteristics of the sound at the observation point P, there is provided a numerical array in which the transient response to be calculated is stored. Such array may be provided in the initialization performed in the processing procedure "A". In the array, a location j in the array in which the transient response is stored is determined depending on a time Dt at which the wave motion reaches the observation point P. Consequently, the result of the transient response corresponding to the time Dt at the observation point P is added and stored in the corresponding location j in the numerical array. More particularly, in the step 46, the time Dt at which the wave motion reaches the observation point P is determined based on the sum of the total distance d between the wave source and the intersection Q of the sound ray vector and the distance RD.

Step 46 is followed by a step 47 in which the location j in the numerical array corresponding to the time Dt is determined. Step 47 is followed by step 48 in which the data in time series obtained in steps 44, 45 is added and stored in the corresponding location j in the numerical array. In the above addition and storing, when some other data is already stored in location j, the data is added to such some other data and the resultant is stored in the location j, whereby the same effect as that in the approximate integration is obtained. Further, by arranging the array location in a manner of time series, it is possible to retrieve the sound-field characteristics at the observation point P in time series (i.e., in the order of the array location), which enables the sound to be reproduced, whereby the method and apparatus for efficiently reproducing the sound are realized.

After completion of the processing procedure "E", data processing continues for the propagation history of a subsequent radiating sound ray vector. When all the data of the propagation history as to the n'th radiating sound ray vector is calculated, the same operation is conducted as to the (n+1)'th radiating sound ray vector. Then, after completion of calculation as to all the radiating sound ray vectors, data processing for a subsequent observation point P is conducted in a manner as shown in FIG. 3.

In summary, in processing procedure "D": the velocity potential of the sound ray vector affecting the observation point P is calculated based on the propagation history of each of the sound ray vectors by the use of integration, the sound ray vector being reflected at the boundary; and, the transient response at the observation point P is determined and stored.

As is clear from the above, a means for accomplishing the processing procedure "D" may be any means, provided that the means processes the stored propagation history by the use of approximate integration. In other words, the means may be: a processing unit operated by the use of software comprising a series of steps; or a computer; or some other unit provided with hardware for executing an appropriate processing procedure by the use of the approximate-boundary integration.

After completion of the processing procedure "D", step 49 shown in FIG. 1 follows it. In step 49, in order to determine the acoustic characteristics of a direct sound issued from the sound source and affecting the observation point P, transient characteristics are added and stored in the location j of the array, the location j corresponding to a time at which the direct sound reaches the observation point P.

Figure 6:
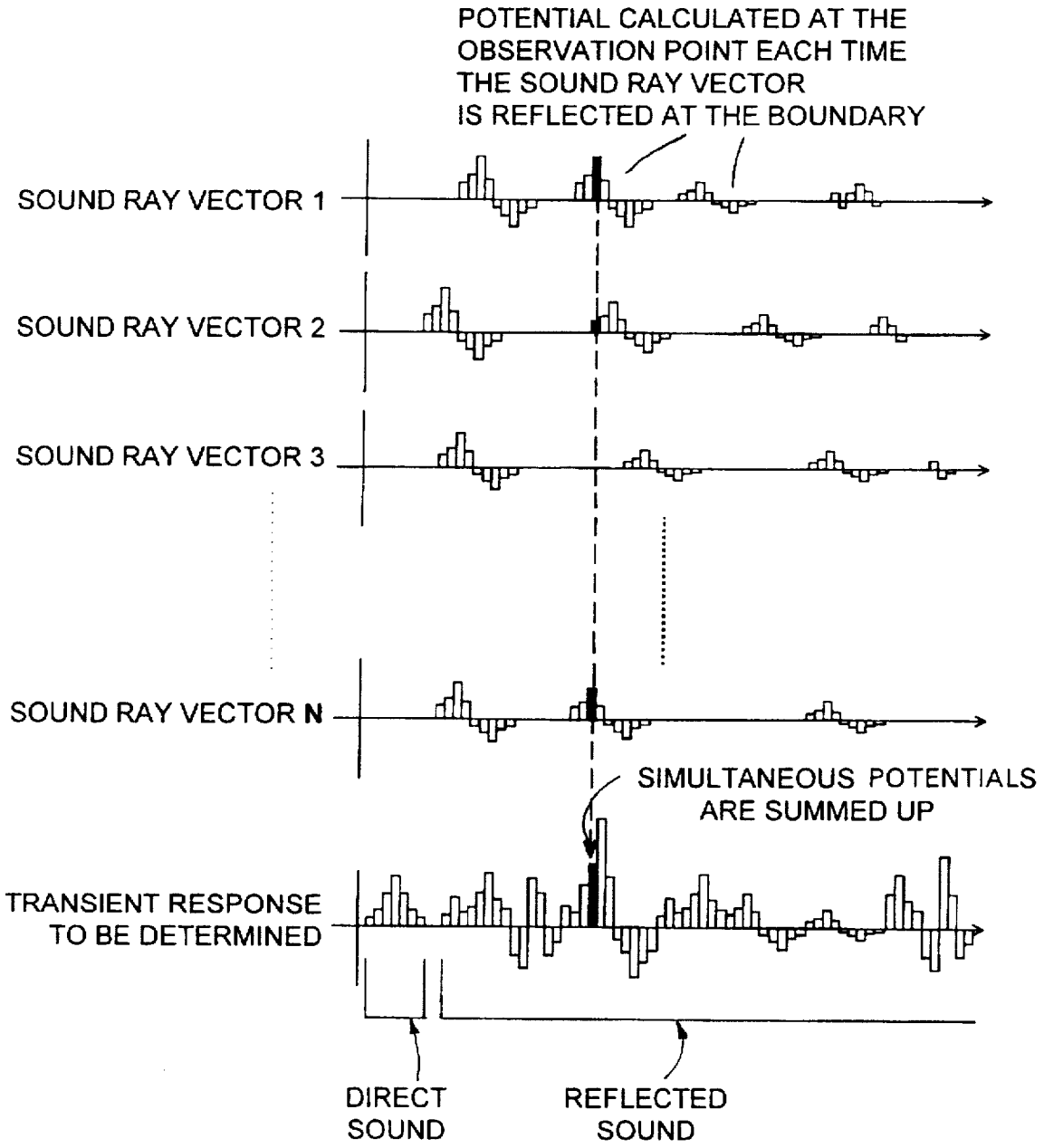
FIG. 6 is a graph of a series of the sound ray vectors and the transient responses of the direct and the reflected sound both to be determined, illustrating their total potential at the observation point versus time.

FIG. 6 shows a graph of a series of the sound ray vectors and the transient responses of the direct and the reflected sound both to be determined, illustrating their total potentials at the observation point P versus time. More particularly, in the processing procedure "B", the potential affecting the observation point P is calculated each time each of the sound ray vectors is reflected at the boundary and stored in time series so that the transient response at the observation point P is determined as a whole. The processing procedure "D" and adding of the direct sound are easily understood with reference to the graph shown in FIG. 6.

After completion of the entire processing procedures and determination of the transient response of a "delta" approximation function given as the initial value, when the result is required in the form of impulse responses, it is possible to obtain such impulse response by executing an inverse sum-of-products calculation in "delta" approximation.

EMBODIMENT 2

Now, a method and apparatus of sound-field synthesis of a virtual sound of the present invention for reproducing a three-dimensional sound field of a virtual space in an actual space (hereinafter referred to as the real space) will be described. Incidentally, a synthesis sound field realized in the real space is hereinafter referred to as the synthesis sound field.

First, an ideal sound field synthesis system will be described.

Figure 7A:
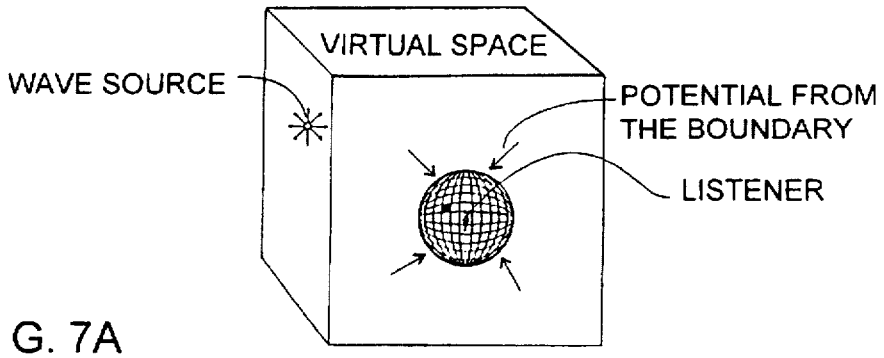
FIG. 7(A) is a perspective view of the virtual space comprising a potential sphere surrounding a listener, illustrating the concept of ideal sound-field synthesis.

In order to give a listener a so-called virtual reality or the feeling that the listener feels as if he/she were in the virtual space, it is ideal that all possible sound waves reaching the listener in the virtual space are synthetically produced in the real space. For example, as shown in FIG. 7(A), in the case that the listener is in a virtual space, the sound waves radiating from the wave source form the direct sounds and the reflected sounds to reach the listener all possible directions. An ideal method for synthetically producing the sound waves (which reach the listener in the virtual space) in the real space is as follows.

Namely, first of all, as shown in FIG. 7(A), a spherical surface surrounding the listener is given, which results in the fact that all the sound waves reaching the listener pass through the spherical surface without fail. Also in the actual world, if it is possible to realize a spherical surface through which the sound waves pass, it is possible for the listener to feel with high accuracy the virtual space in the real space. Such spherical surface in the real space is hereinafter referred to as the ideal sound-field synthesis apparatus.

The ideal sound-field synthesis apparatus is provided with a infinite number of micro acoustic generators in its surface. The micro acoustic generators continuously spread out over the entire surface of the apparatus to radiate the sound waves which are composed and reach the listener. The micro acoustic generator does not reflect sound waves issued from the other micro acoustic generators.

It is necessary to know when and what kind of sound waves are radiated from the micro acoustic generators at a time when the wave source radiates the sound. In this case, it is necessary for an electronic computer to calculate the impulse response at a time when the sound waves are issued from the wave source in a condition in which the micro acoustic generators on the spherical surface serve as the observation points. In this connection, since it is not possible to treat the infinite number of the micro acoustic generators in calculation, the number of the micro acoustic generators is defined to be a large number "M" for convenience of calculation.

As for each of the "M" pieces of the impulse responses thus calculated, an arbitrary acoustic signal is subjected to a convolution transformation in a sum-of-products calculator. As a result, the sound waves are radiated from the "M" pieces of the micro acoustic generators. The sound waves thus radiated from the "M" pieces of the micro acoustic generators are composed to produce a sound field of the virtual space which is defined by the spherical surface so as to surround the listener.

Figure 7B:
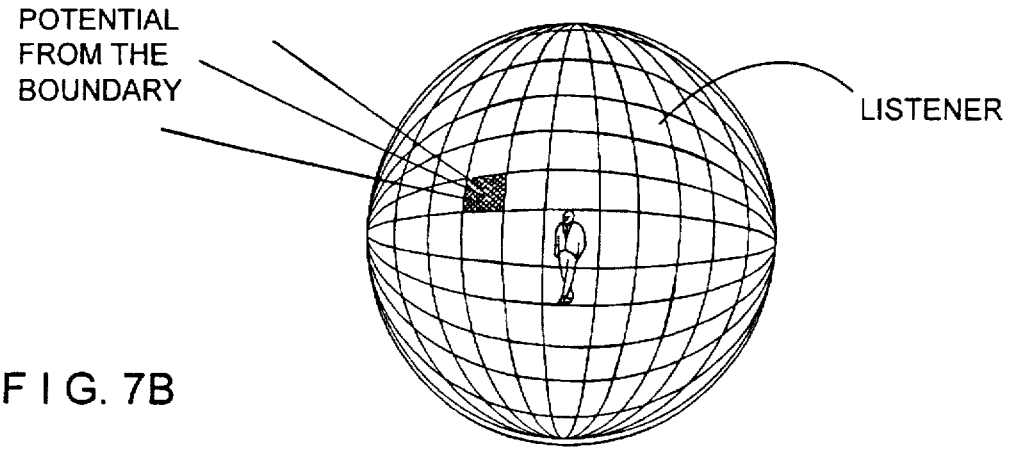
FIG. 7(B) is a partially enlarged perspective view of the potential sphere shown in FIG. 7(A)
Figure 7C:
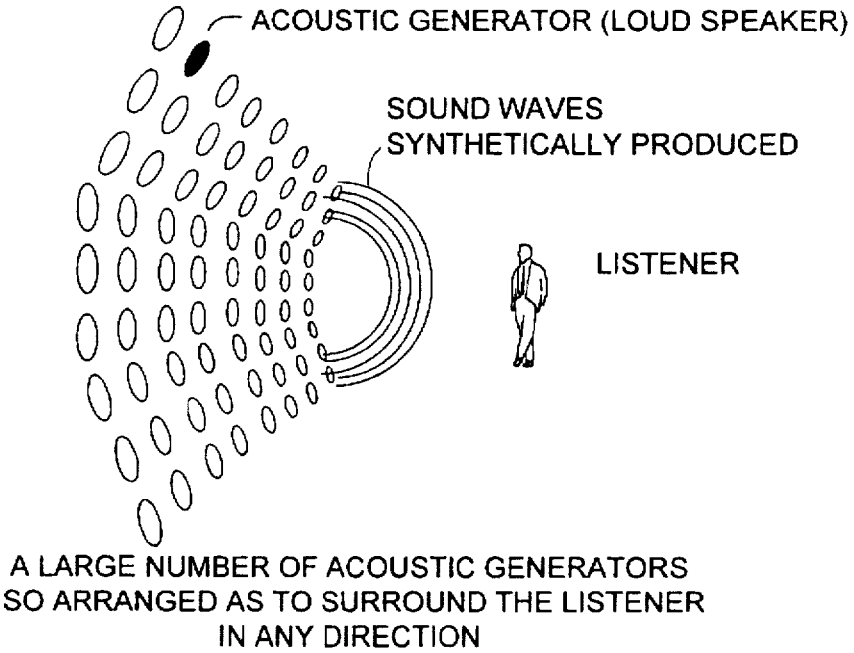
FIG. 7(C) is a further enlarged view of the potential sphere shown in FIG. 7(B)

As shown in FIG. 7(B), the spherical surface surrounding the listener is divided into "M" pieces of micro areas each of which forms an acoustic generator. FIG. 7(C) illustrates the concept of the ideal sound-filed synthesis apparatus of the present invention, in which each of the micro areas for producing "M" pieces of sounds is replaced with a circle representing a loud speaker. The sound waves radiated from each of the loud speakers represented by the circles show in FIG. 7(C) are composed to form a wave front reaching the listener. Based on Huygens' principle, time interval at which the individual loud speakers are arranged must be within a quarter of a wave length of the highest frequency. For example, in case that a sound field comprising of frequencies up to 20 KHz is composed, since the wave length of 20 KHz is approximately 1.7 cm, it is necessary to define the interval of the loud speakers so as to be approximately 0.425 cm, which is however not possible in practice. As for the number of acoustic generators, the more the number increases, the more the continuity of acoustic generators is improved in the space. On the other hand, from an economical point of view, it is desirable to use the least possible number of acoustic generators in the apparatus of the present invention.

Figure 8:
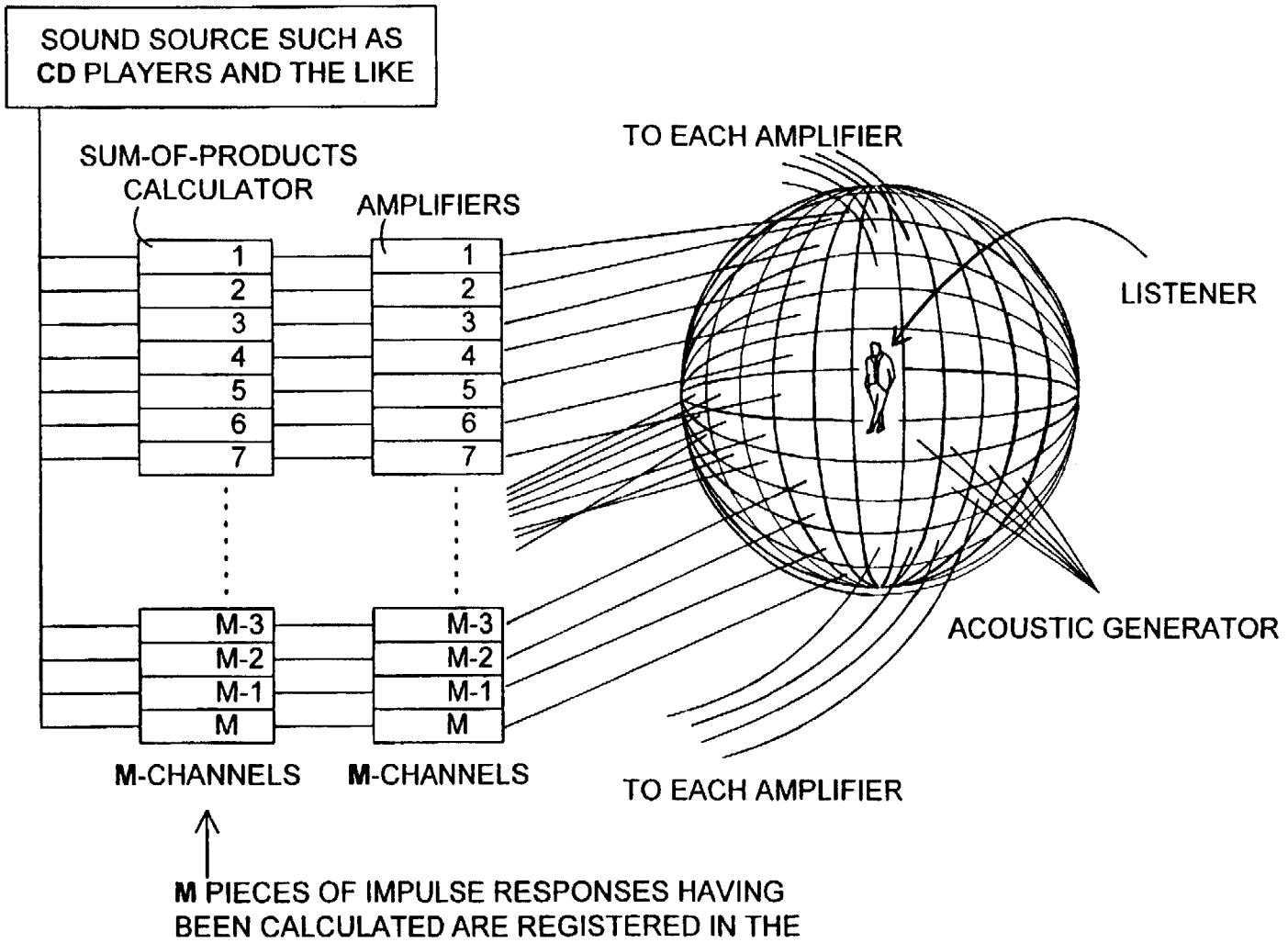
FIG. 8 is a schematic diagram of an ideal sound-field synthesis apparatus.

Shown in FIG. 8 is a sound-field synthesis system which uses the largest possible number "M" of acoustic generators. In this case, it is possible for the listener to enjoy an ideal virtual reality space produced with high accuracy. However, as is clear from the drawings, it is necessary to provide an equal number of amplifiers and an equal number of channels of the sum-of-products calculator to that of the acoustic generators having been arranged so as to surround the listener, which considerably increases the cost.

EMBODIMENT 3

In order to solve the above economical and technical problems, the following measures will be adopted to realize a more realistic sound-field synthesis.

Figure 9A:
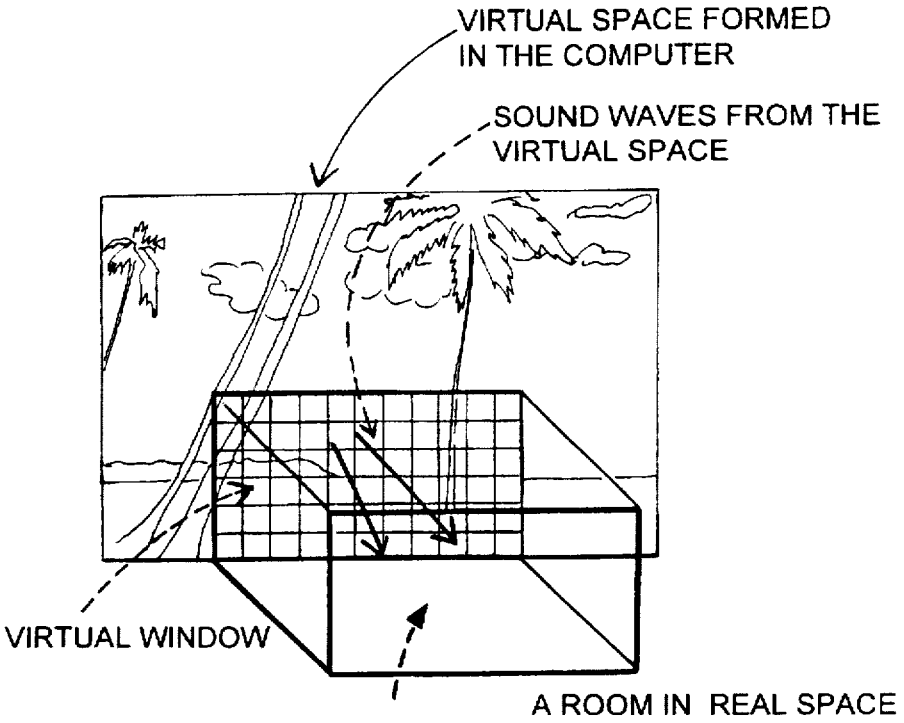
FIG. 9(A) is a perspective view of both the virtual space and the real space, illustrating the relationship therebetween, i.e., the concept of sound-field synthesis by the use of a so-called virtual window method.
Figure 9B:
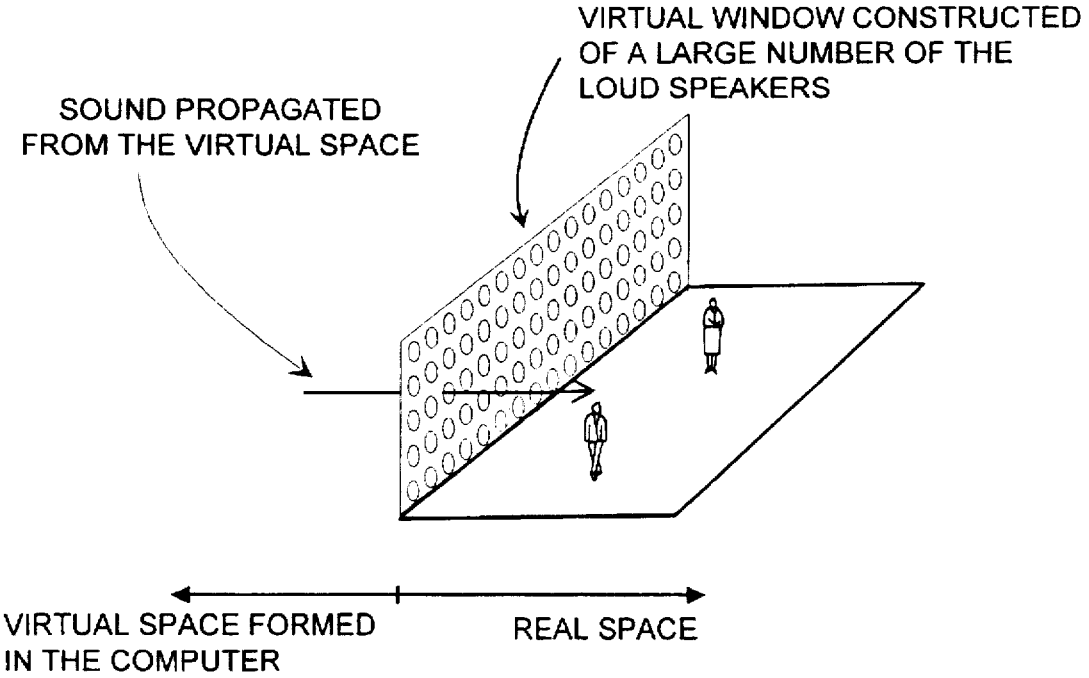
FIG. 9(B) is a partially enlarged view of FIG. 9(A)

Shown in FIGS. 9(A) and 9(B) is a sound-field synthesis method using the concept of a so-called virtual window. A simple chamber or room called a real sound field is provided, in which the sound field of the virtual space is synthetically produced. In case that the virtual space of a sandy beach formed in a computer is synthetically produced in the real space, as shown in FIG. 9(A), there is provided a window (i.e., virtual window) in a wall surface of the real sound field, through which window the virtual space is realized in the real sound field. Such virtual window is constructed of acoustic generators of the ideal sound field synthesis apparatus of the present invention shown in FIG. 7(C), the acoustic generators being disposed in a plane of the wall surface of the real sound field.

In this sound-field synthesis method, the sound waves propagated from the virtual space enter the real sound field through the wall surface thereof. As a result, the listener in the room with such window extending over the entire wall surface of the room may feels as if he/she were at a sandy beach. As is clear from FIG. 9(B), one of features of the sound field synthesis method of the present invention lies in the fact that the listener may assume any position in the room.

On the other hand, it is necessary to calculate the impulse response for any one of the acoustic generators disposed in the virtual window of the virtual space. In case that the virtual space is set as if it were a sandy beach, multiple sound sources are used in calculation of the impulse response. For example, as for a so-called surf sound, it is necessary to provide multiple of sound wave sources at the beach, and calculate the impulse response as to both such wave sources and all acoustic generators. Since the number of the thus calculated impulse responses is the same as that of the wave sources for any one of the acoustic generators in the virtual window, these impulse responses are summed up and allotted to each of the acoustic generators.

As described above, the virtual window, of which the acoustic generators are disposed in a plane such as the wall surface and the like, may be easily understood when the real sound field is set in a living space. When a picture screen which is acoustically transparent is provided in the vicinity of the acoustic generators disposed in the plane, it is possible to construct a virtual reality system with sound and picture excellent in acoustic realism.

Figure 10:
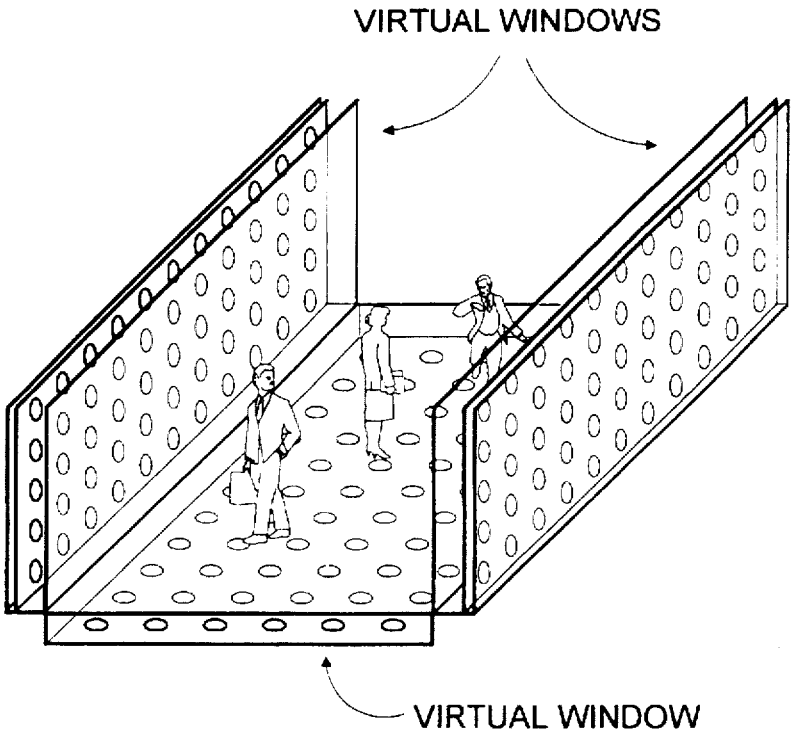
FIG. 10 is a perspective view of the real space provided with a pair of wall surfaces and a floor surface, in each of which surfaces the virtual window is disposed.

Further, as shown in FIG. 10, a virtual window may be provided in each of the remaining wall, floor and ceiling surfaces of the room so as to substantially realize sound-field synthesis properties of the ideal sound field synthesis apparatus. Also as is clear from the drawings, when the picture screen which is acoustically transparent is disposed in a front surface of the virtual window, it is possible to additionally provide a picture in the acoustic virtual space, which realizes a more improved picture system.

Incidentally, as is in the description of the ideal sound field synthesis apparatus given above, as the number of acoustic generators increases, the realism of the apparatus is improved. It is preferable to continuously dispose acoustic generators over the entire surface. As already described above, the continuity of acoustic generators depends on the frequency of the sound to be reproduced. In order to realize a most preferable sound-field synthesis in theory, it is necessary to dispose the acoustic generators at predetermined intervals of up to a quarter of a wave length of the highest one of frequencies of the sound waves to be reproduced. In other words, in a system for realizing a sound-field synthesis with only low frequencies, the number of acoustic generators used therein is smaller than that of acoustic generators used in a system for realizing a sound-field synthesis with high frequencies.

Figure 11A:
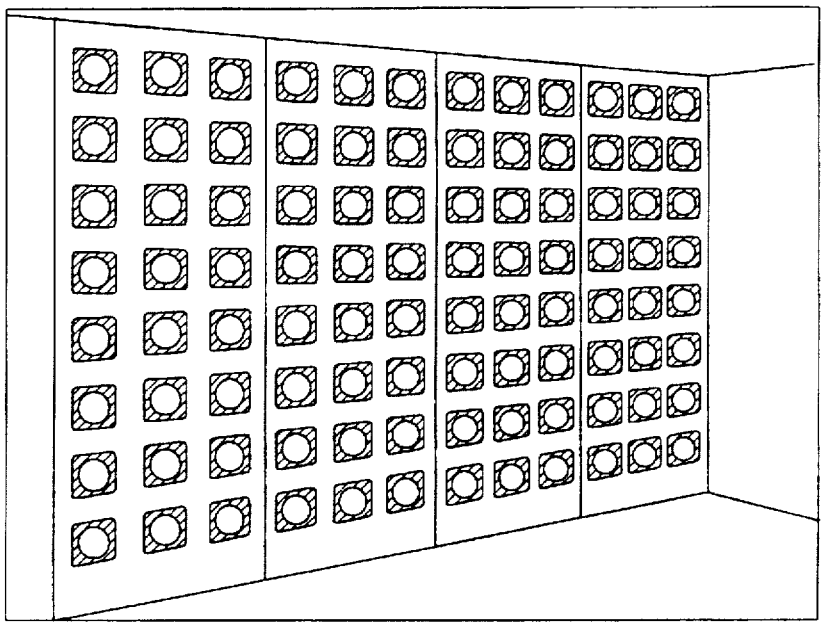
FIG. 11(A) is a perspective view of the virtual window using 96 loud speakers which perform as acoustic generators.
Figure 11B:
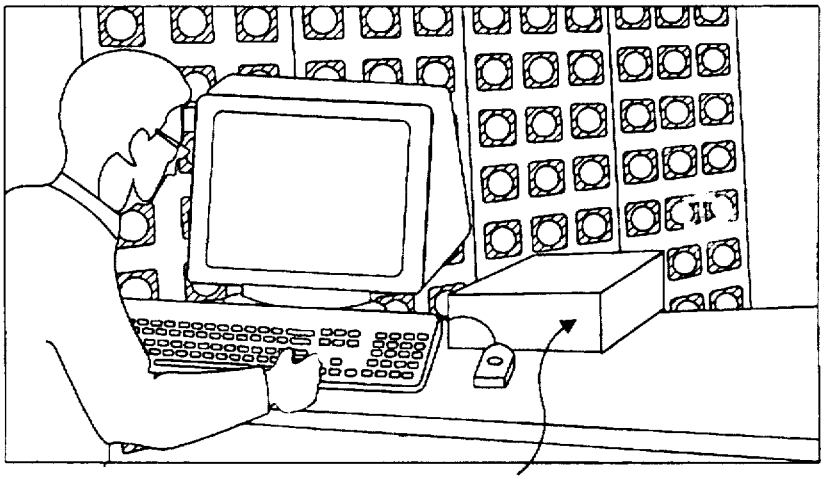
FIG. 11(B) is a view similar to FIG. 11(A), illustrating the sum-of-products calculator with 24 channels.
Figure 12:
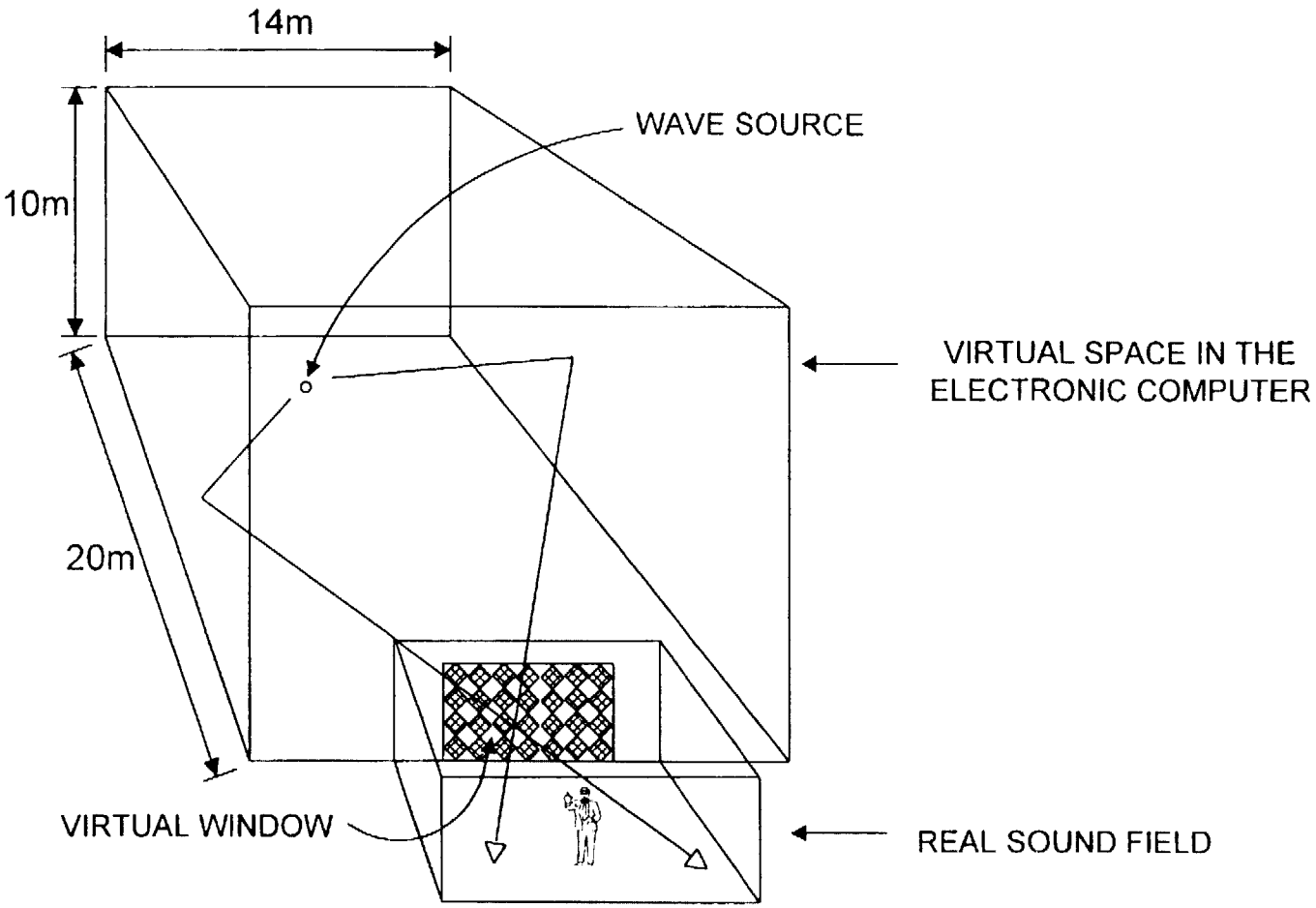
FIG. 12 is a perspective view of the virtual space in the electric computer and the real space, illustrating the concept of connecting the virtual space to the real space through the virtual window.

Shown in FIG. 11(A) is a photograph of a virtual window which comprises 96 pieces of loud speakers serving as sound generators. These loud speakers are disposed at intervals of approximately 19.5 cm in both horizontal and vertical directions. This virtual window is capable of synthetically producing sound field using frequencies of up to approximately 435 Hz with high accuracy. Using this virtual window, an experiment of the sound-field synthesis was conducted. In the virtual window, there were 96 pieces of loud speakers of which: for every four speakers, one channel was allotted, and, therefore a sum-of-products calculator provided with 24 channels was used together with amplifiers to carry out a simplified sound-field synthesis method of the present invention. Shown in FIG. 11(B) is a photograph of the sum-of-products calculator provided with 24 channels. In the calculation of the sound-field synthesis of the virtual space, a space having a width of 14 m, a height of 10 m and a depth of 20 m was imaged so as to connect to the real sound field through the virtual window. Such connection between the virtual space and the real sound field through the virtual window is shown in FIG. 12. When the virtual window is so set as to cover all the surfaces (i.e., the number of which surfaces is 6) of the real sound field, the real sound field is contained within the virtual space.

In the calculation of the sound field, since one channel was allotted every four loud speakers, 24 impulse responses were calculated. The base point of the calculation of the impulse responses was the center of the four speakers. The number of the sound sources was three. In the calculation of the impulse responses, sampling frequencies of 1 KHz, 8 KHz and 32 KHz were set. The length of the data of the impulses was 65536 data.

Used in the listening test were: a piano which served as the sound source disposed in an anechoic chamber; male and female voices in narration; a drum; a flute, and the like.

In sound-field synthesis using the impulse response with a sampling frequency of 1 KHz, communication between sounds reproduced by the individual loud speakers was good. Even with the sampling frequency of 8 KHz, any considerable change in such communication was not recognized, and it was possible to clearly recognize the position of the piano and the like disposed in the virtual space provided with the virtual window. Especially, even when the listener continuously changed his position in the real space, the position of the sound in the virtual space did not change, enabling the sound image to be very natural. In sound-field synthesis using impulse response with a sampling frequency of 32 KHz, the sound image of musical instruments such as high-hat cymbals that produce sound with high frequencies, identification of the position became slightly poor, and at high frequencies often became noisy. This was due to the fact that synthesis of the sound waves having high frequencies fails to be continuous when each of the intervals of generators in the virtual window is larger than a wave length of the highest frequency of the sound to be reproduced. Provided as a simple measure in this case is the application of an appropriate low-pass filter to the reproduced sound.

In any case, sound-field synthesis according to the method of the virtual window was capable of giving the listener a high quality feeling of realism.

It is clear that the method and apparatus of the ideal sound-field synthesis shown in embodiment 2 and those of embodiment 3 based on the concept of the virtual window are all easily applicable to the following fields. First, they are applicable as a method and apparatus for supporting sound fields such as concert halls, opera houses and the like. In a concert hall, the sound may often vary in acoustic characteristics when the listener moves to a different place with in the correct hall. In some instances, the sound normally produced on the stage reaches the listener or audience in a form without acoustic balance. In this case, by arranging the loud speakers in an upper portion of the concert hall, or in a lower portion of the concert hall, or in the wall surfaces and the like, it is possible to compensate the sound field in acoustic balance so as to provide the ideal acoustic characteristics according to the present invention, which makes it possible to substantially realize the ideal acoustic characteristics of the sound. In other words, by actively using such idea of supporting the sound field, it is possible for the audience to enjoy the same sound effect as that of a famous concert hall even when they are in a hall which has poor acoustic characteristics. This idea is also applicable to movie theaters, rooms, public squares and the like. In these places, multiple loud speakers are positioned so that each loud speaker serves as each of the virtual windows, allowing sound waves passing through the virtual windows of the virtual space to be synthetically reproduced, which enables the audience to enjoy acoustic realism of the sound field of the virtual space wherever the audience is. Further, the present invention is also applicable any other apparatuses, such as televisions, radios, record players, compact disk players and like apparatuses, and still further applicable to electronic sounds in electronic pianos and electronic musical instruments and voice-generating media, whereby another method and apparatus for enabling the audience to enjoy virtual reality in the sounds are provided according to the present invention.

EMBODIMENT 4

Turning now to a fourth embodiment of the present invention, it will be observed that there are used at least two acoustic generators for synthetically producing the sound field. The method and apparatus of the virtual window described above is a practical one for realizing the ideal sound field synthesis and may realize a sound field synthesis having sufficient performance. However, it is further preferable from economical point of view to reduce the number of acoustic generators and the number of the channels of the sum-of-products calculator used for such sound field synthesis apparatus.

Figure 13:
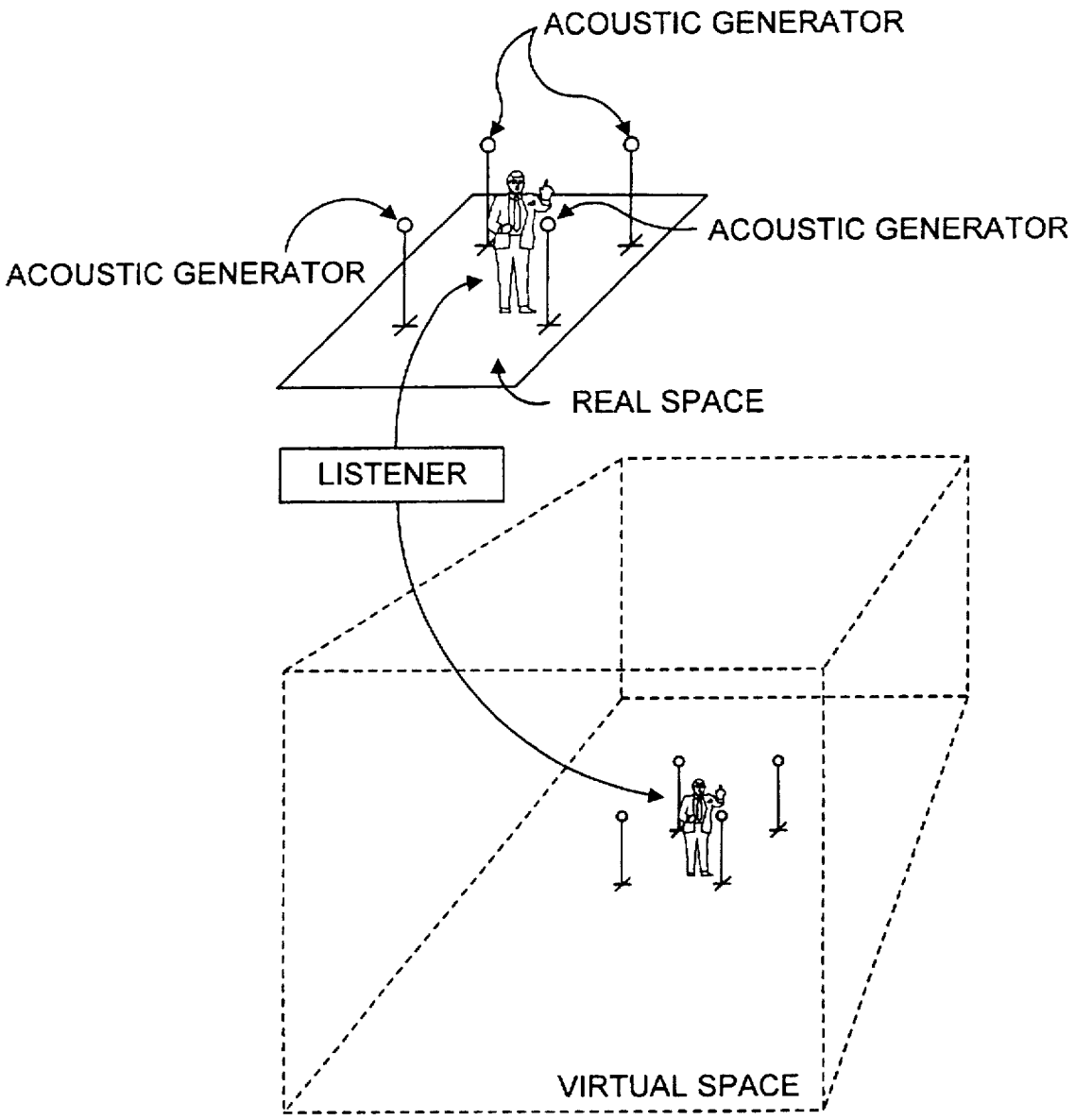
FIG. 13 is a perspective view of the virtual space in the real space that is provided with 4 acoustic generators for realizing sound-field synthesis, illustrating the relationship between these spaces.

FIG. 13 shows the relationship between the virtual space and the real space used in sound field synthesis using 4 pieces of the acoustic generators. If the sound waves (which are propagated in the virtual space numerically constructed in the electronic computer) are synthetically produced using 4 pieces of the loud speakers disposed in the real space, it is possible for the listener to enjoy acoustic realism as if he is in the virtual space.

Figure 3A:
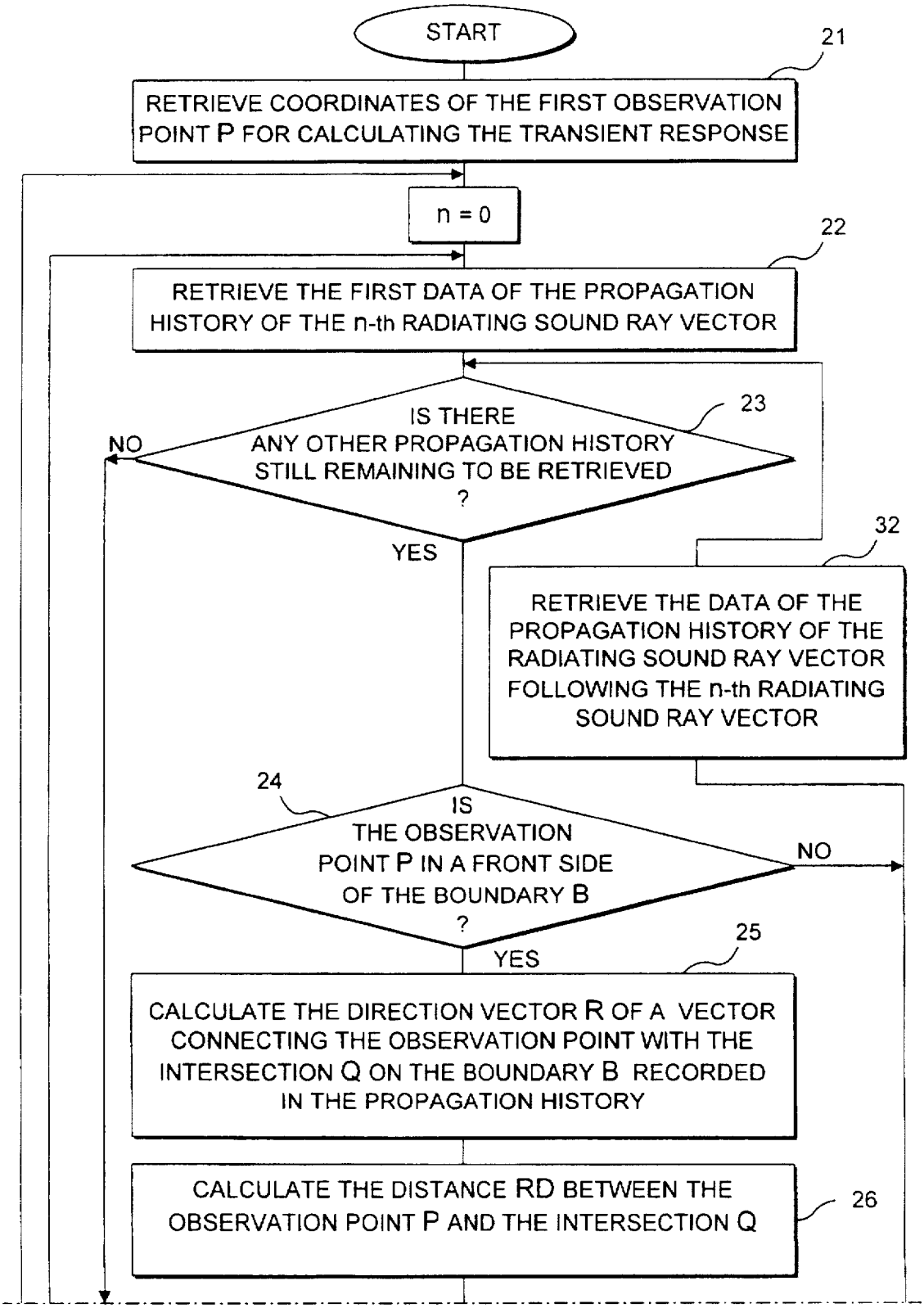
FIGS. 3A and 3B is a flowchart illustrating the processing procedure "D" of FIG. 1 for calculating the transient response based on the propagation history of each of the sound ray vectors by the use of a so-called approximate boundary integral.
Figure 3B:
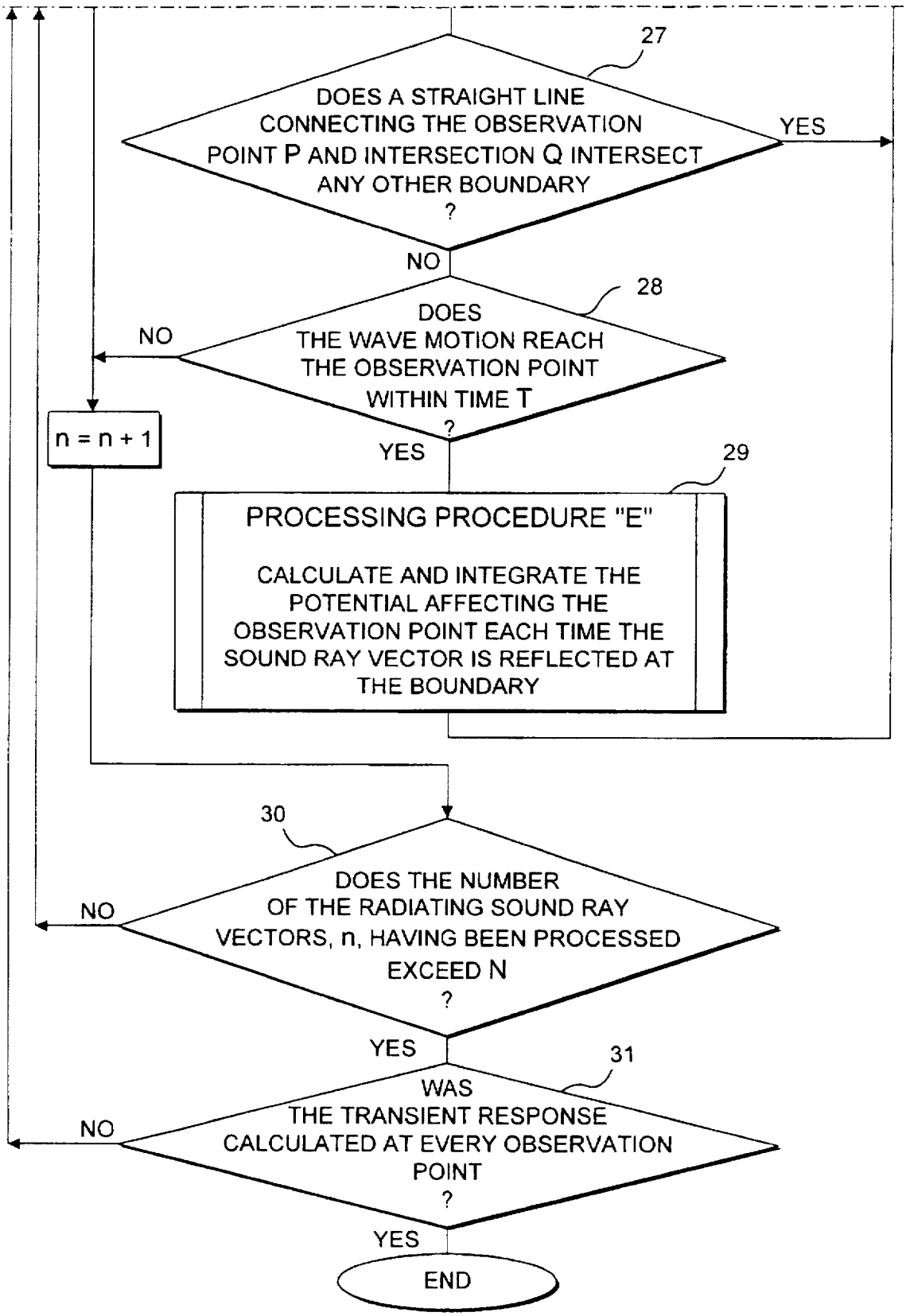
Figure 14:
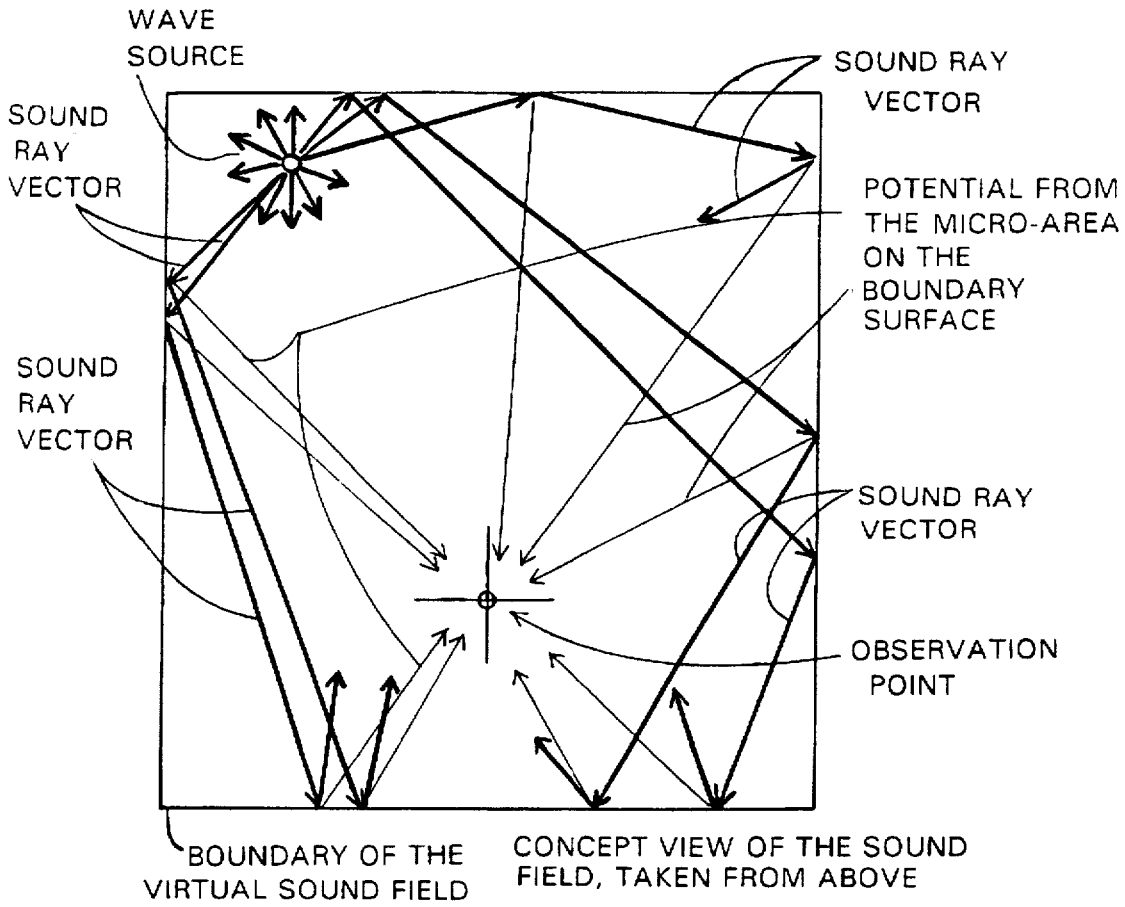
FIG. 14 is a planned view of the virtual space, illustrating the concept of the sound-field synthesis using 4 acoustic generators.
Figure 15:
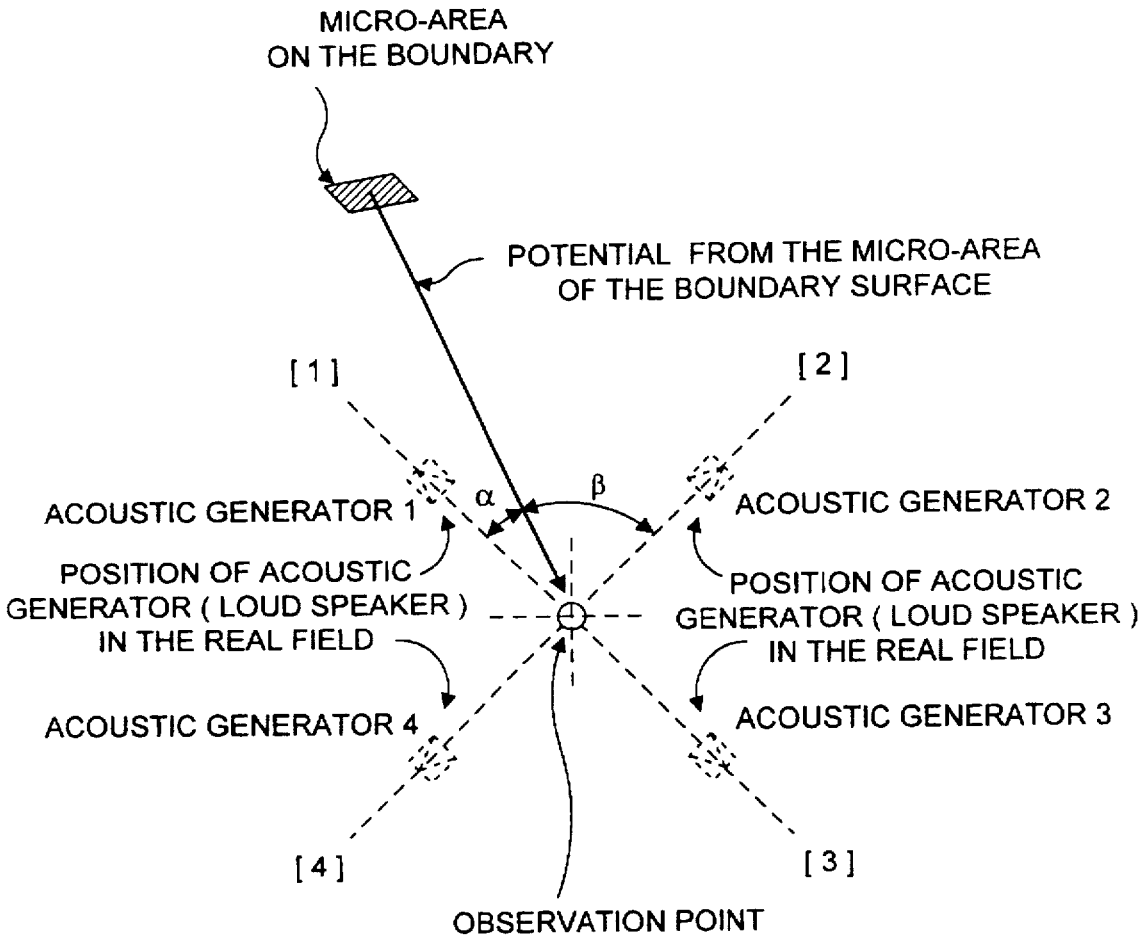
FIG. 15 is a planned view of the real space, illustrating the concept for finding an integral of potential from the boundary surface as to each directions in which such potential affect the observation point.

In comparison with each of the ideal sound field synthesis apparatus and the method of sound field synthesis using the virtual window, the number of acoustic generators used in the method shown in FIG. 3 is considerably reduced, which makes it difficult to synthetically produce a sound field that is acoustically realistic, even when the impulse response of the virtual space is merely calculated at positions corresponding to those 4 acoustic generators and used in sound field synthesis. The reason for the difficulty described above is that it is not possible to synthetically produce with high accuracy the sound waves propagated between acoustic generators having been positioned apart from each other. In order to solve this problem, as shown in FIGS. 14 and 15, a method for calculating the sound field for synthetically producing an approximate sound field by using an acoustic generator having been positioned apart from each other is provided. As is clear from FIGS. 14 and 15, in this method, there are 4 acoustic generators. Incidentally, each of FIGS. 14 and 15 is a plan view of the observation point.

Since sound field synthesis is realized using 4 acoustic generators, the potentials from the boundary surface reach the observation point (i.e., the listener's position) and are integrated in each of four directions so that 4 impulse responses are calculated. Such integration is conducted in a manner shown in FIG. 15. In Kirchhoff's integral or in the approximate-boundary integral, the potential from the micro area on the boundary, which reaches the observation point, is integrated. Namely, as shown in the drawings, the potential from the micro area affects the observation point. In case that the potential is propagated between the acoustic generators 1 and 2, that potential is divided into two parts in the following manner, each of which part is integrated as to each of the acoustic generators 1 and 2. As shown in FIG. 15, the above dividing is conducted using angles "α" and "β" of the observation point. As for the impulse response to be calculated for acoustic generator 1, a ratio of "β/(α+β)" of the potential is integrated. On the other hand, for the impulse response to be calculated for acoustic generator 2, a ratio of "α/(α+β)" of the potential is integrated. The same calculation is conducted as to any other potential propagated between the remaining acoustic generators, whereby 4 pieces of the final impulse responses are obtained. Also, as for the direct sound, the same calculation as is in the above is conducted.

Figure 16:
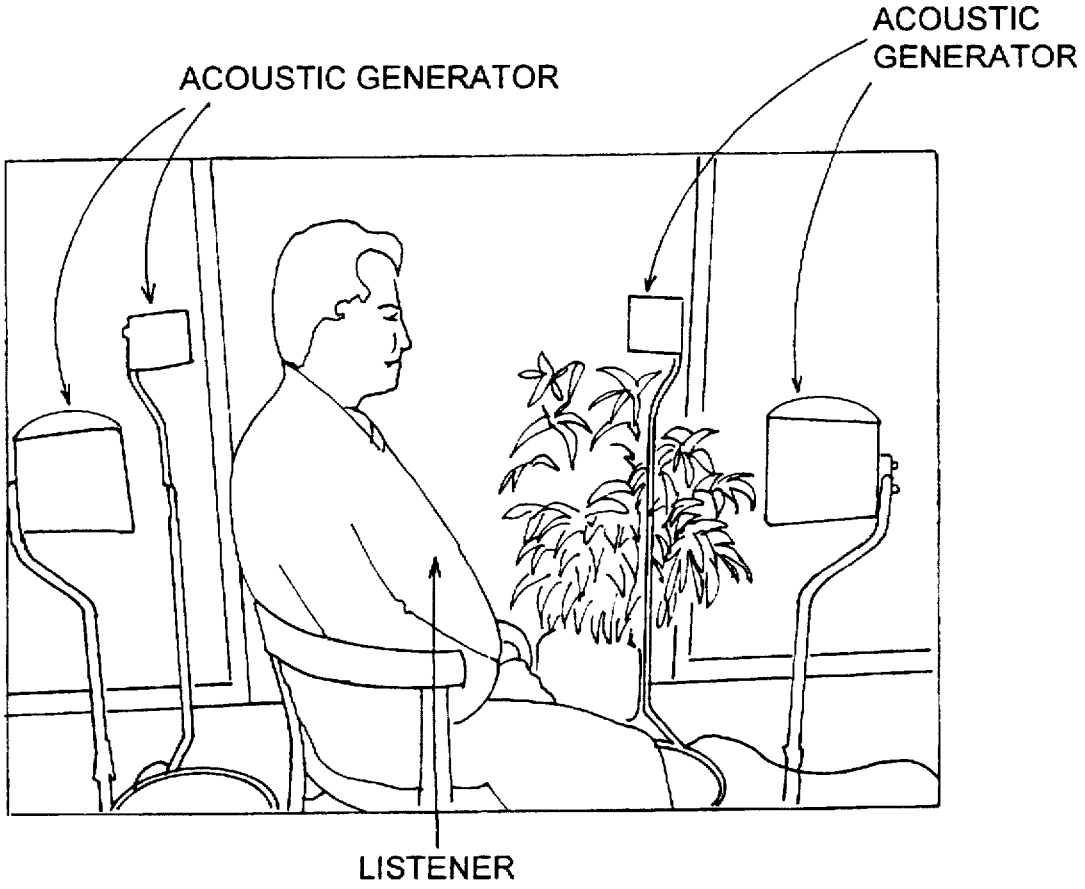
FIG. 16 is a perspective view of a concrete example of the real space using 4 acoustic generators.

In the method shown in FIGS. 14 and 15, since 4 acoustic generators are disposed in a horizontal plane, it is essentially not possible to compose the sound waves in vertical directions. Under such circumstances, calculation is conducted by assuming that all the sound waves issued from a wave source (which is out of the above horizontal plane) to the observation point reach the observation point in horizontal directions. As a result of a listening test that is conducted, a sound source such as a piano and the like is in the horizontal plane, it is possible to for the listener to sufficiently enjoy acoustic realism without feeling any undesirable effect. Shown in FIG. 16 is photograph in which 4 acoustic generators are disposed in a concrete manner.

Figure 17:
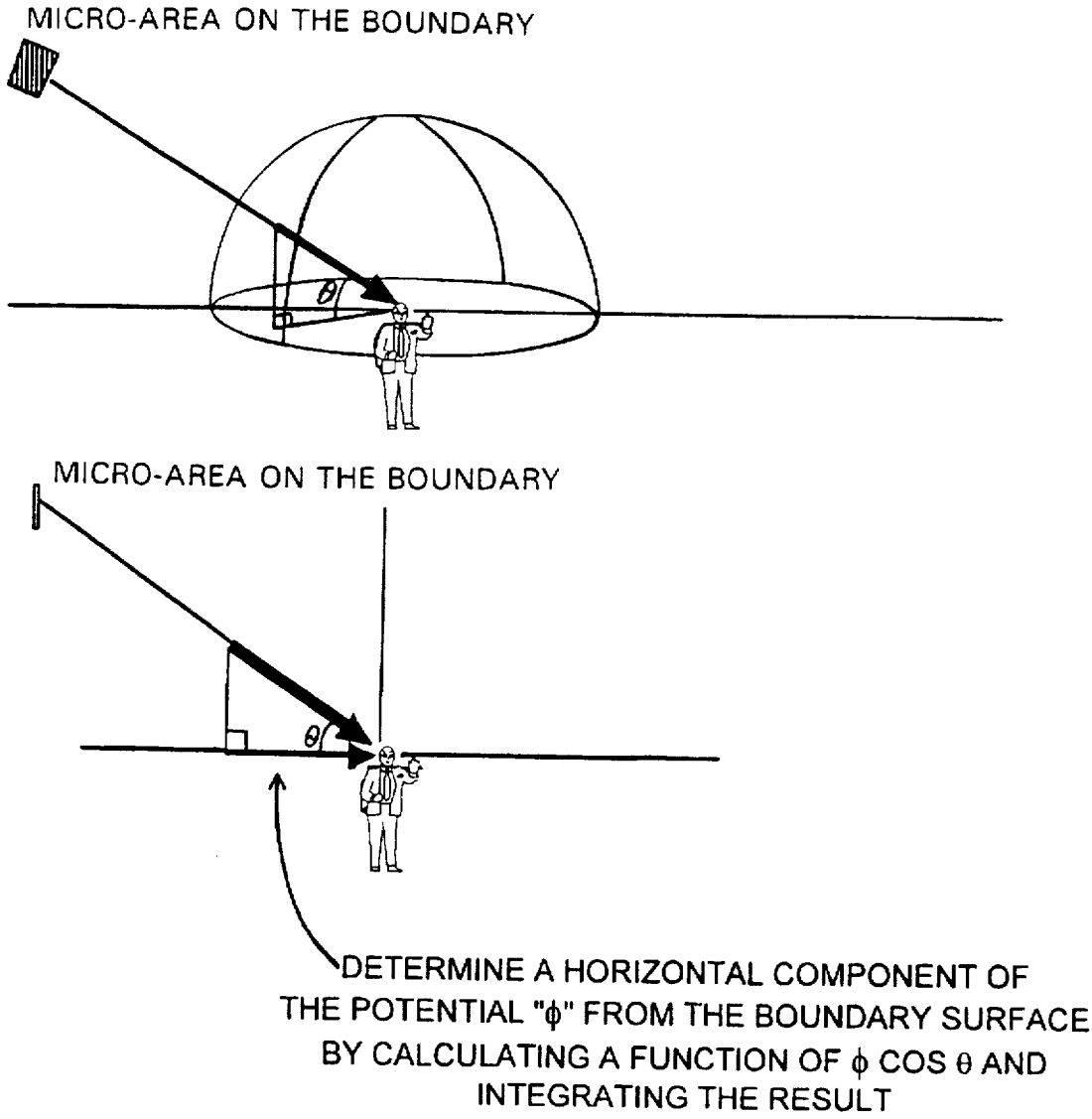
FIG. 17 is a perspective view of the real space, illustrating the concept for finding an integral of horizontal components of potential from a micro-area on the boundary.

Incidentally, as shown in FIG. 17, in case a vertical angle "θ" is formed between the horizontal plane and a line connecting the micro area of the boundary surface with the observation point, i.e., in case that the potential with the vertical angle "θ" reaches the observation point, a horizontal component of such potential may be calculated using a function of cosθ, and the thus calculated horizontal component may be integrated.

In order to synthetically produce a natural position of the sound image and the reflected sound also in vertical directions, at least one additional acoustic generator is provided over the horizontal plane, i.e., over such 4 acoustic generators. Integral calculation in this case of the provision of the additional acoustic generator may be conducted in the same manner as that of the case in which only 4 acoustic generators are disposed in the horizontal plane.

EMBODIMENT 5

Now, an approximate sound field synthesis for enlarging the listening area of at least 4 acoustic generators will be clarified.

Figure 18:
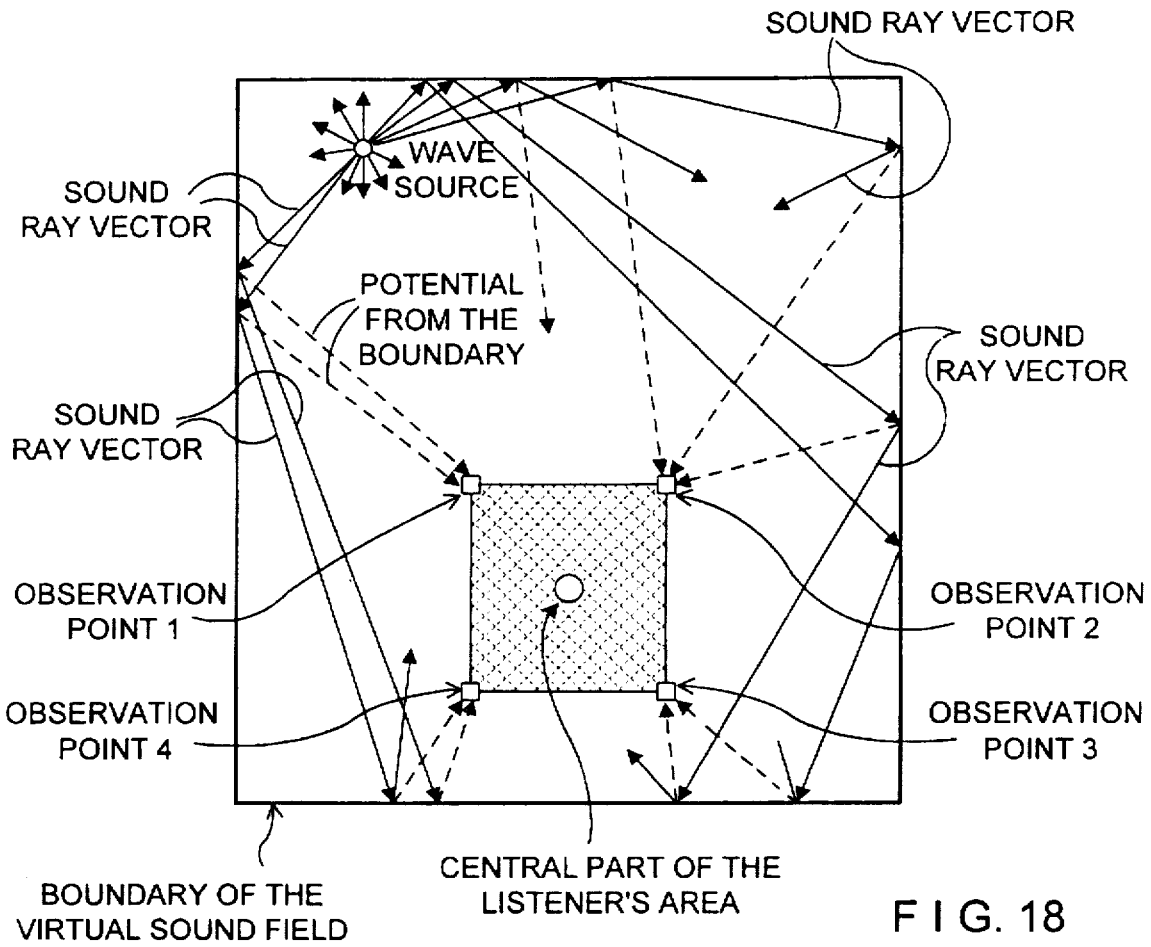
FIG. 18 is a plan view of the virtual space, illustrating the concept of a so-called approximate sound-field synthesis method for enlarging a listening area using 4 acoustic generators.
Figure 19:
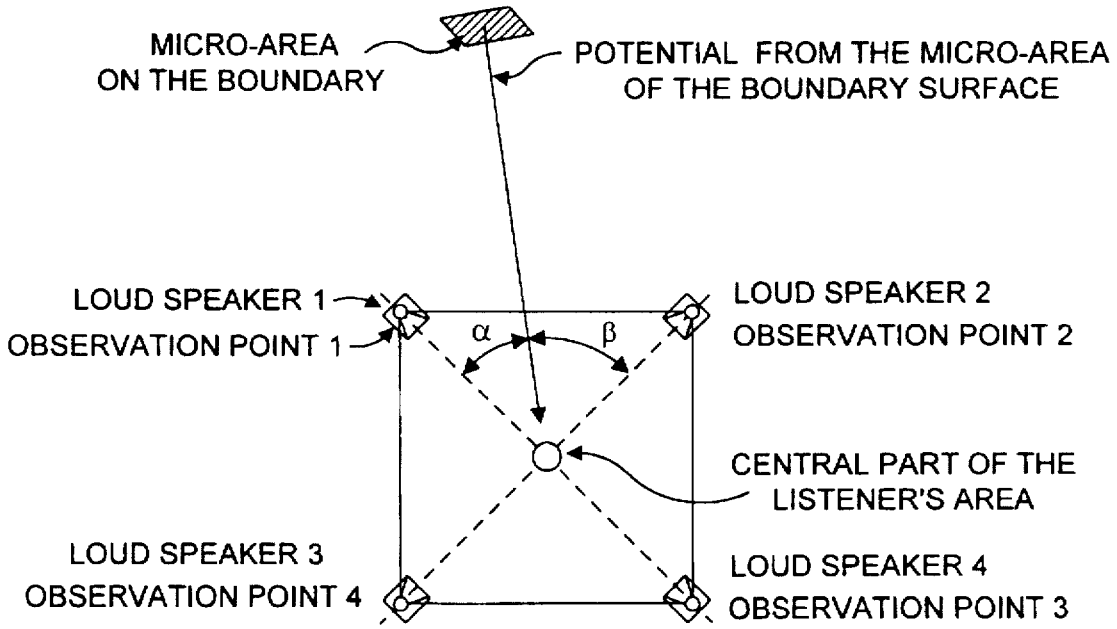
FIG. 19 is an enlarged plan view of the listening area shown in FIG. 18, illustrating the concept for finding an integral of the potential from the boundary surface as to each of directions in which such potential affects the observation point.

Clarified in the sound field synthesis using 4 acoustic generators described above are calculation of the sound field and the method of sound field synthesis in case that only one listener is in the sound field. However, in some applications, it is better from an economical point of view, for the sound field synthesis system to be modified so that the system is capable of admitting a plurality of the listeners to the sound field, which also enables the system to be applicable in various fields. FIGS. 18 and 19 show a method of approximate sound field synthesis for enlarging the listening area using 4 acoustic generators.

This method is different from the above-described method of sound field synthesis using 4 acoustic generators in the following point: namely, in this method shown in FIGS. 18 and 19, the number of the observation point increases to 4, at each of which point Kirchhoff's integral is conducted in the virtual space, the thus increased observation points corresponding in position to 4 acoustic generators. In other words, the position of each of the 4 sound generators in the real space is equal to that of each of four observation points in the virtual space.

When the potential from the micro area of the boundary as shown in FIG. 19 affects the observation points, i.e., is propagated between the observation points 1 and 2, such potential is divided into two parts each of which is integrated for each of the observation points 1, 2. As shown in FIG. 19, such dividing is conducted using angles "α" and "β" of a central point of the listening area surrounded by 4 acoustic generators. More particularly, for the impulse response calculated at observation point 1, a ratio of "β/(α+β)" of the potential is integrated. On the other hand, for the impulse response calculated for observation point 2, a ratio of "α/(α+β)" of the potential is integrated. The same calculation is conducted as to any other potential propagated between the remaining acoustic generators, whereby 4 final impulse responses are obtained. Also, for the direct sound, the same calculation as above is conducted.

According to the method of calculation described above, sound field synthesis on a stage of a multipurpose hall was conducted, the stage being simple in shape and relatively small in size. The multipurpose hall had a width of 14 m, a height of 15 m and a depth of 20 m, and the stage thereof was provided with a listening or listener s area of 3 m×3 m. Since this multipurpose hall had a reverberation time of approximately one second, 65536 data was set for the impulse response.

The wave sources disposed in the virtual space were a pair of proscenium loud speakers.

When popular music and the like was reproduced from the proscenium loud speakers in the virtual space, it was found that the listener enjoyed the sound field in size and acoustic realism with much higher accuracy than that in the case of the above-described sound field synthesis in which 4 acoustic generators were used.

Figure 20:
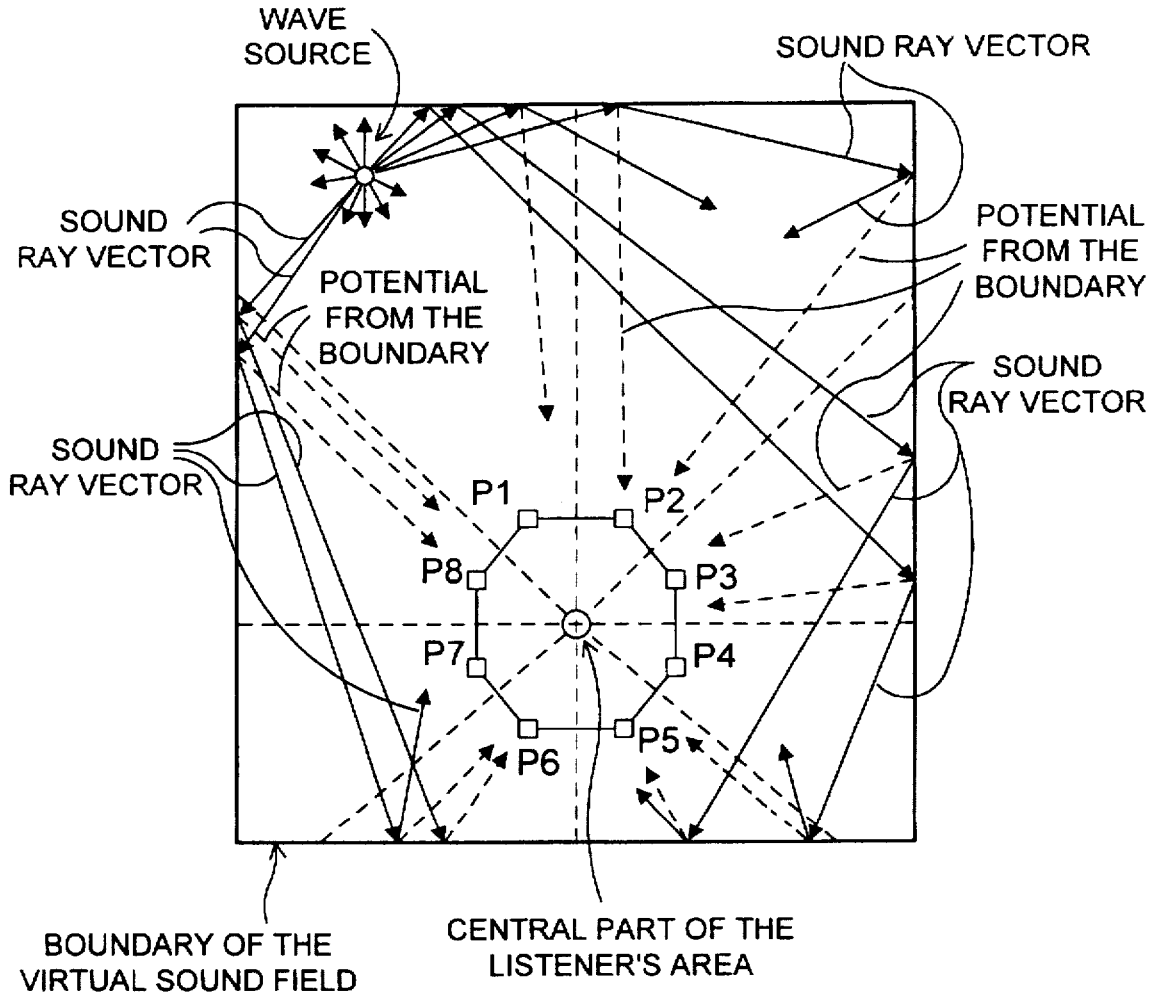
FIG. 20 is a planned view of the virtual space, illustrating the concept of the sound-field synthesis method for further enlarging the listening area using 8 acoustic generators.

Shown in FIG. 20 is an example of sound field synthesis which is realized using 8 acoustic generators. As shown in FIG. 20, eight observation points P1–PB are arranged so as to form a circular shape surrounding a listening area. This shape may be modified to any other suitable shapes such as rectangular shapes, square shapes and the like. The 8 observation points P1–PB correspond to the acoustic generators disposed in the real space. Used in the example shown in FIG. 20 is the same method of calculation as that used in the case of the above-described sound field synthesis using 4 acoustic generators, so that the impulse response is calculated at each of the observation points. When the sound field synthesis was conducted using the same virtual space as above, it was found that the listener enjoyed a sound field that had much higher feeling of acoustic realism than that in the case of the above-described sound field synthesis using 4 acoustic generators, and that the listener identified the position of the wave source more clearly.

EMBODIMENT 6

Now, a sixth embodiment of the present invention will be described, in which the present invention is applied to a so-called "Karaoke".

Karaoke is an entertainment in which a user sings his or her favorite song with accompaniment using a microphone connected to an echo machine, as if the user were a famous singer. The user of Karaoke wants to feel as if he/she were a professional singer singing on the stage of a concert hall. Further, for musical instruments and songs, education and training may become more effective by the use of Karaoke, for the user can enjoy an ideal acoustic environment of being realized on the stage of a concert hall. On the other hand, today's Karaoke is a system for merely reproducing the user's song with accompaniment through an echo machine and loud speaker, and, therefore is not capable of providing an environment in which the user can feel as though he/she were singing a song on the stage of a concert hall or in a music studio. This is because the acoustic difference, between a three-dimensional live sound field such as that created in an actual concert hall, and a plain sound field realized by the use of sound that is reproduced a loud speaker after passing through an echo machine, is considerably large. In the present invention, a three-dimensional sound field, which is substantially the same as that created in an actual concert hall, is synthetically produced around the user of Karaoke, enabling him/her to enjoy virtual reality, i.e., feel as if he/she were on the stage of a famous concert hall and the like. Further, when a user plays a musical instrument, since he/she can the acoustic characteristics of a enjoy famous concert hall according to the present invention, it is possible for the user to acquire excellent musical education.

The above is realized according to the present invention as follows: namely, a process showing how the sound waves propagated in the three-dimensional sound field (which is to be synthetically produced) reach the user, is processed by an electronic computer in a manner as previously described in the present invention (hereinafter referred to as sound field simulation); and, based on the thus obtained acoustic information, a virtual sound field is synthetically produced in the real space by the use of the sum-of-products calculator, digital-to-analog converter, loud speaker, amplifiers and the like.

The above acoustic information is obtained by calculating the process showing how the sound waves propagated in the sound field (which is numerically constructed in the electronic computer, and, therefore hereinafter referred to as the virtual space or virtual sound field) reach the user. Consequently, the acoustic information is of the transient response such as the impulse response. Further, in the transient response, it is necessary to represent the sound waves reaching the user in each of the directions. This calculation is executed based on the number and the positions of the loud speakers used when the virtual sound field is synthetically produced in the real space.

The transient response is obtained by calculating the sound by means of the sum-of-products calculator, the calculator being provided with a plurality of channels corresponding to the number of the loud speakers and the number of the sound sources in the virtual space.

Figure 21:
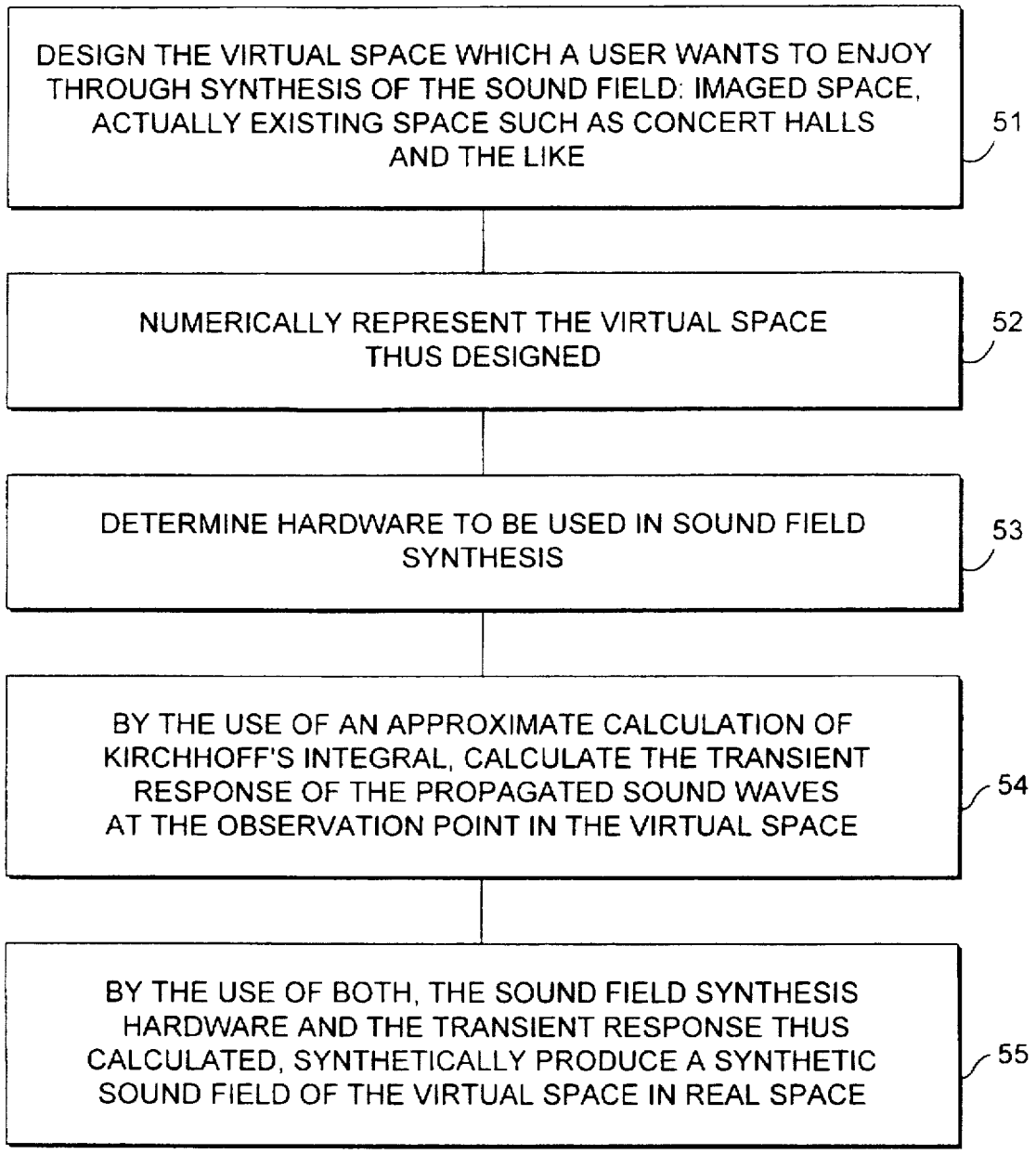
FIG. 21 is a block diagram illustrating the flow of the processing procedure for realizing the synthesis of a virtual space in real space.

The actual method of the present invention for reproducing the sound in a virtual space will be described with reference to a flowchart shown in FIG. 21.

First of all, various data is set before the computer simulation of the sound field is carried out. Setting contents in the above comprise: setting of the virtual space in step 51; numerical representation of the virtual space in step 52 following step 51; and, determination of hardware to be used for sound field synthesis in step 53 following step 52. In step 51 for setting the virtual space such as various types of concert halls which the user wants to enjoy is designed so as to determine or set: the shape and size of the space; the number and positions of sound sources; required frequency bands; and, the listener's position. Registered in the computer in step 52 for numerically representing the virtual space thus designed are: the boundary such as the wall surface; objects disposed in the sound field; types and material of the boundary; and, the speed of the sound. These data enable the computer to calculate. In step 53 for determining the hardware used in sound field synthesis, in order to have the user enjoy virtual sound in real space, the number and positions of the loud speakers are determined or set. The processing order of steps 51 to 53 may be interchanged.

In step 54 following step 53, the simulation of the sound field is carried out so that the transient response of the sound propagated in the virtual space is calculated, the virtual space depending on the type of the sound field synthesis hardware. The process described in step 54 is substantially the same as that described in the preceding embodiment with the exception of the number and positions of the sound sources. Such process is described again in the following embodiment of the present invention for better understanding of the invention.

In step 55 following step 54, the virtual space is synthetically produced in real space. The transient response is input to the sum-of-products calculator so that the sound field is synthetically produced by the use of sound field synthesis hardware, whereby the sound field of the virtual space is reproduced, which enables the user to experience a virtual sound field.

Now, the apparatus for reproducing virtual sound, carried out by the method for reproducing virtual sound as described in the preceding embodiment of the present invention, will be described in a concrete manner. For example, the method of the present invention described above is applicable to apparatus for synthetically producing the sound field with reality, the apparatus being disposed around the user of Karaoke.

In order to synthetically produce a sound field that is acoustically realistic, it is important to consider the following matters 1 to 4: namely, 1. It is important to reproduce the sound that reaches the user, comprising of the user's singing voice with accompaniment, that is reproduced and issued from electro-acoustic systems such as proscenium loud speakers, side-wall loud speakers, stage loud speakers and like systems normally installed in concert halls, multipurpose halls and the like.

For example, in general, the singing voice (for example, a popular song) of the user singing on a stage of a virtual space reaches a mixer after passing through a microphone and an echo machine, in an actual space. Then, the user's singing voice is mixed with the accompaniment of the musical band and the like in the mixer, amplified in the power amplifier, and then issued from the proscenium loud speakers, side-wall loud speakers, stage loud speakers and the like. At this time, the sound issued forward from the proscenium loud speaker radiates to the audience and a rear portion of the concert hall, and is reflected at the auditorium, rear walls, side walls and the ceiling of the hall, so that a part of the reflected sound returns to the user singing on the stage.

In the remaining directions except one in which the proscenium loud speaker faces toward the audience, for example, in the direction towards the stage, the musical sound generally biased towards its lower-tone side depending on directional frequency, characteristics of the proscenium loud speaker are radiated together with the user's voice to reach the user on the stage in a relatively short time. In order to improve the sound in acoustic realism, it is important to simulate the what user the hears concerning both, the sound which passes through the audience area and the sound which is issued from the loud speaker directly to the user. This is true for the remaining loud speakers such as the side-wall loud speakers installed in the side walls of the hall, stage loud speakers and monitor loud speakers installed on the stage and the like.

In order to realize the above, the following steps (1), (2) and (3) are required:

(1) Acoustic simulation of sounds with directional frequency characteristics of multiple sound sources such as loud speakers installed in virtual space is carried out to calculate the transient response in individual directions in which the sounds reach the user;

(2) The sounds radiated from multiple sound sources are calculated in reflection, absorption, diffraction, transmission and diffusion occurring at the boundary which forms the virtual space constructed in an electronic computer, the boundary comprising of, for example, walls and the audience of the concert hall, auditorium, floor, stage, ceiling, reflector boards, stage curtains, other types of curtains and the like; and (3) In the above acoustic simulation, the transient response is calculated with consideration for attenuation of the sound caused by atmospheric damping effect.

2. It is also important to further improve the sound the user hears in acoustic reality by simulating the applause of the audience so as to synthetically produce the sound in the real space. As is in actual cases, communication between the singer and the audience is carried out through applause and the like. Consequently, it is very important to simulate applause and the like for the Karaoke system. In some cases, it is also often necessary to synthetically produce some kind of noise such as chattering and the like occurring in the entire auditorium.

The above is realized by the use of the following steps (1), (2) and (3):

(1) Multiple of sound sources are set in the auditorium in the virtual space to serve as the virtual audience. Sound propagation from the sound sources (i.e., audience) to the user on the stage is simulated, so that the transient response is calculated in the individual directions in which the sounds reach the user. In acoustic simulation, the transient response is calculated with consideration for the attenuation in sound caused by atmospheric damping effect;

(2) When it is required to improve the acoustic simulation described above from an economical point of view, it is possible to reduce the number of the sound sources (i.e., audience) by the use of a stereo-type sound source constructed of a pair of sound sources installed in the auditorium of the virtual space. Namely, this is simulation of a stereo audio system for reproducing applause in the virtual space; and (3) In order to lend higher acoustic realism to the sound field, the timing of the applause produced by the virtual audience can be automated. The beginning and the ending of the user's song are automatically detected to control the timing of the applause of the virtual audience.

3. As is in actual case, in some cases, it is necessary to simulate players of a musical band and the like in a position behind or in front of the user facing the auditorium on the stage. In general, the players are behind the user. However, in operas, they are in front of the user on the stage.

The above is realized by the following steps (1) and (2): namely, (1) Multiple of sound sources corresponding to individual musical instruments are disposed in their positions so that the transient response is calculated in each individual directions in which the sounds reach the user. In this calculation, the directional frequency characteristics of the musical instruments are also calculated; and (2) From an economical point of view, a simple method is used in which a stereo-type loud speaker is simulated in an area of the players who are behind or in front of the stage in the virtual space, so that the sound issued from the stereo-type loud speaker represents the players and the musical band.

4. Some music requires the users to perform a duet. In this case, each of the users often wants to sing together with a famous singer. Therefore, it is necessary to produce a virtual image of a famous singer, whose image is adjacent to the user on the virtual stage.

The above is realized by the following step (1): namely, (1) Acoustic simulation is carried out in a condition in which a sound source is installed in the position of the virtual singer (hereinafter referred to as the duet singer) adjacent to the user, so that the transient response is calculated in individual directions in which the sounds reach the user. At this time, a part of the duet singer's singing voice is also issued from another simulated sound source such as loud speakers and the like. Now, sound field synthesis, which is carried out using 4 the loud speakers according to the above method will be described. As for the acoustic simulation, approximate calculation is carried out based on the approximate boundary integral represented by equation 3 which is obtained based on the assumption that the sound source is a point source. Variables used in the equation 3 are the same as those shown in equation 1.

Figure 22:
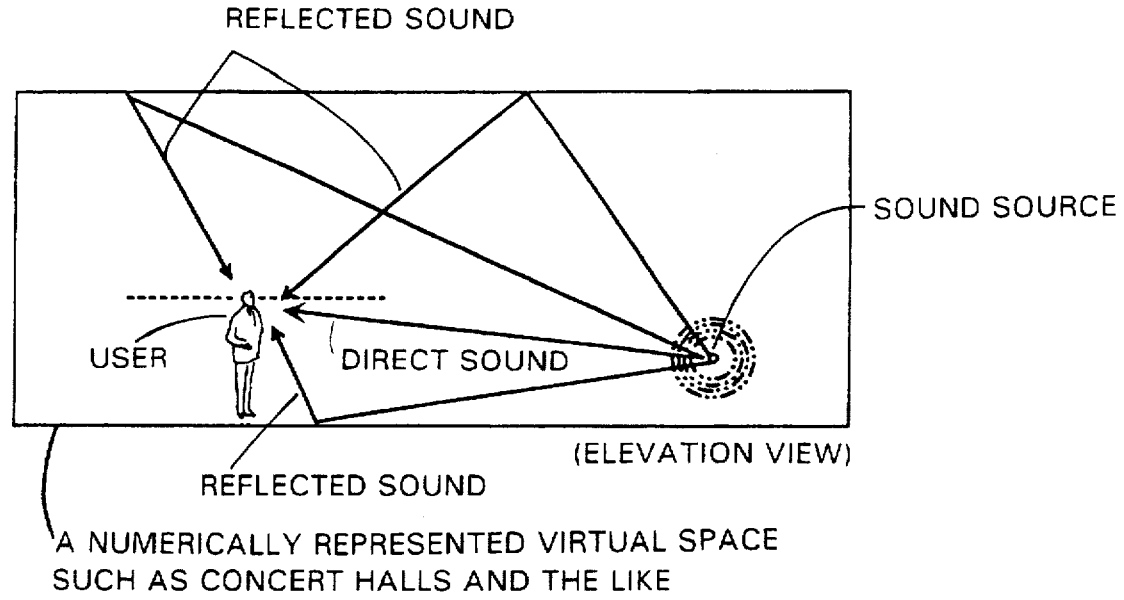
FIG. 22 is a view of the concept of calculation illustrated in side and planned views, by the use of which calculation the transient response in each of directions is calculated in the case that 4 loud speakers are used.
Figure 22:
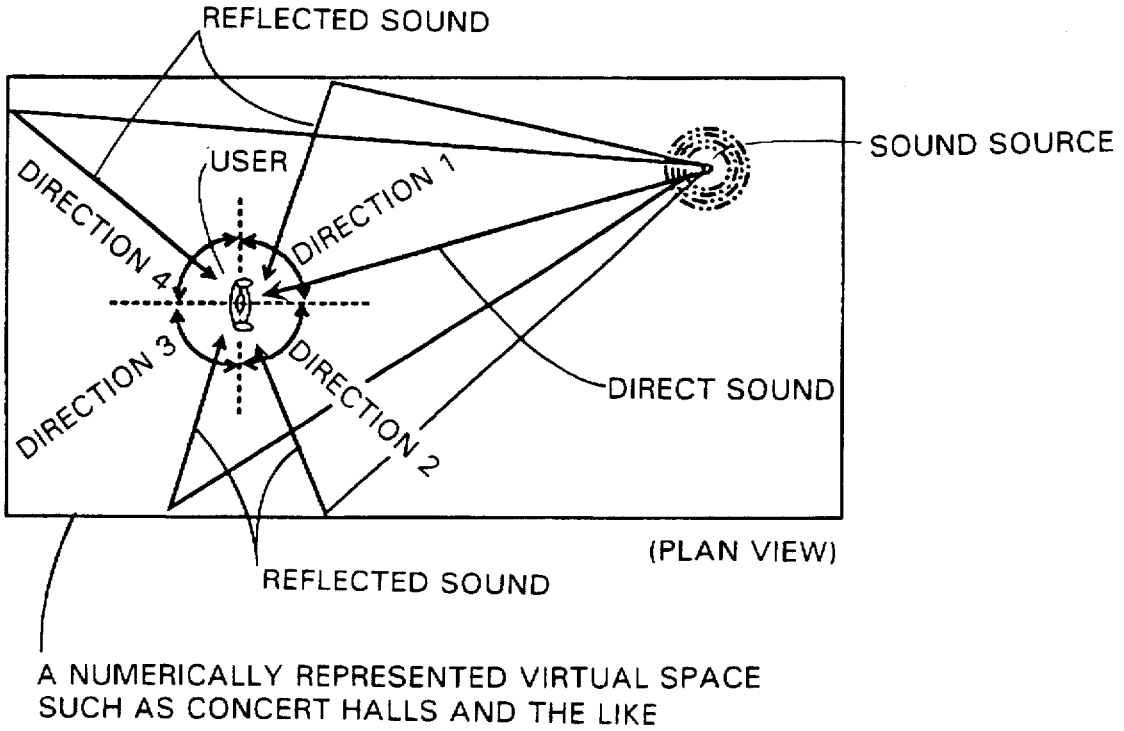

In case that there are, for example, 4 loud speakers (i.e., acoustic generators) which are used in synthetic production of the sound in the real space, as shown in FIG. 22, the transient response such as the impulse response of sound issued from the sound source to the point P is calculated in each of four directions. At this time, a sound field with directional frequency characteristics of the sound source is simulated. In the case 8 loud speakers are used for synthetically producing the sound in real space, the transient response such as the impulse response is calculated in each of eight directions in substantially the same manner as above. In case that the number of the loud speakers is not the same as above, the transient response is determined in substantially the same calculation manner. Further, it is also possible to obtain better effects by setting loud speakers in three-dimensional arrangements.

In order to realize close simulation of what the user hears, as to the indirect and the direct sound produced by the electro-acoustic system such as various types of loud speakers and the like installed in the virtual space, it is necessary to determine how the sound waves (which are radiated from the loud speakers) reach the user on the stage by carrying out calculation with proper consideration for directional frequency characteristics of the loud speakers. Further, for the applause of the audience and musical instruments on the stage, it is preferable to consider their directional frequency characteristics. Still, further, in case that the user plays a musical instrument, the directional frequency characteristics of such musical instruments need to be considered.

As for the directional frequency characteristics of loud speakers and of musical instruments, it is a great convenience to use measured values thereof. The measured values are obtained at measuring points which are disposed in a three-dimensional arrangement around the sound source at angular intervals of 10 degrees. The impulse responses measured at the measuring points are used in calculation.

In the approximate boundary integral according to equation 3 which is an approximation of Kirchhoff's integral, a way of propagation of the sound waves radiated from the sound source through the virtual space is traced. The sound waves are represented by a large number of dots forming a wave front. It is considered that each of the large number of such dots of the wave front carries the initial value (normally, pulses) and is propagated. At this time, when the sound waves (i.e., dots in the wave front) are reflected from the reflecting point of the boundary defining the virtual space, the velocity potential from such reflecting point affects the observation point, based on which the transient response of the sound waves at the observation point is calculated. At this time, with respect to the initial value, the impulse response (i.e., measurements of the directional frequency characteristics of the sound source in each of the directions) is calculated by the sum-of-products calculator.

When the sound waves are reflected at the wall surface of the virtual space, a part of the sound wave is absorbed by the material of the wall surface. In order to calculate the acoustic influence of the wall-surface material, with respect to a value of a representative point of the wave front, reflection characteristics of the wall-surface's material are calculated by a sum-of-products calculator. It is preferable to have the reflection characteristics of the wall-surface's material correspond to the impulse response. This impulse response corresponds to a reflected part of the sound, the reflected part being measured as one impulse response when an impulse is incident on the material at every angle. However, normally, it is impossible to measure such impulse responses at every angle with respect to various types of the materials in practice. Therefore, in actual use, an approximate impulse response is calculated based on the material's sound absorption coefficient which is determined by the use of a so-called reverberation method of the sound absorption coefficient.

Figure 23:
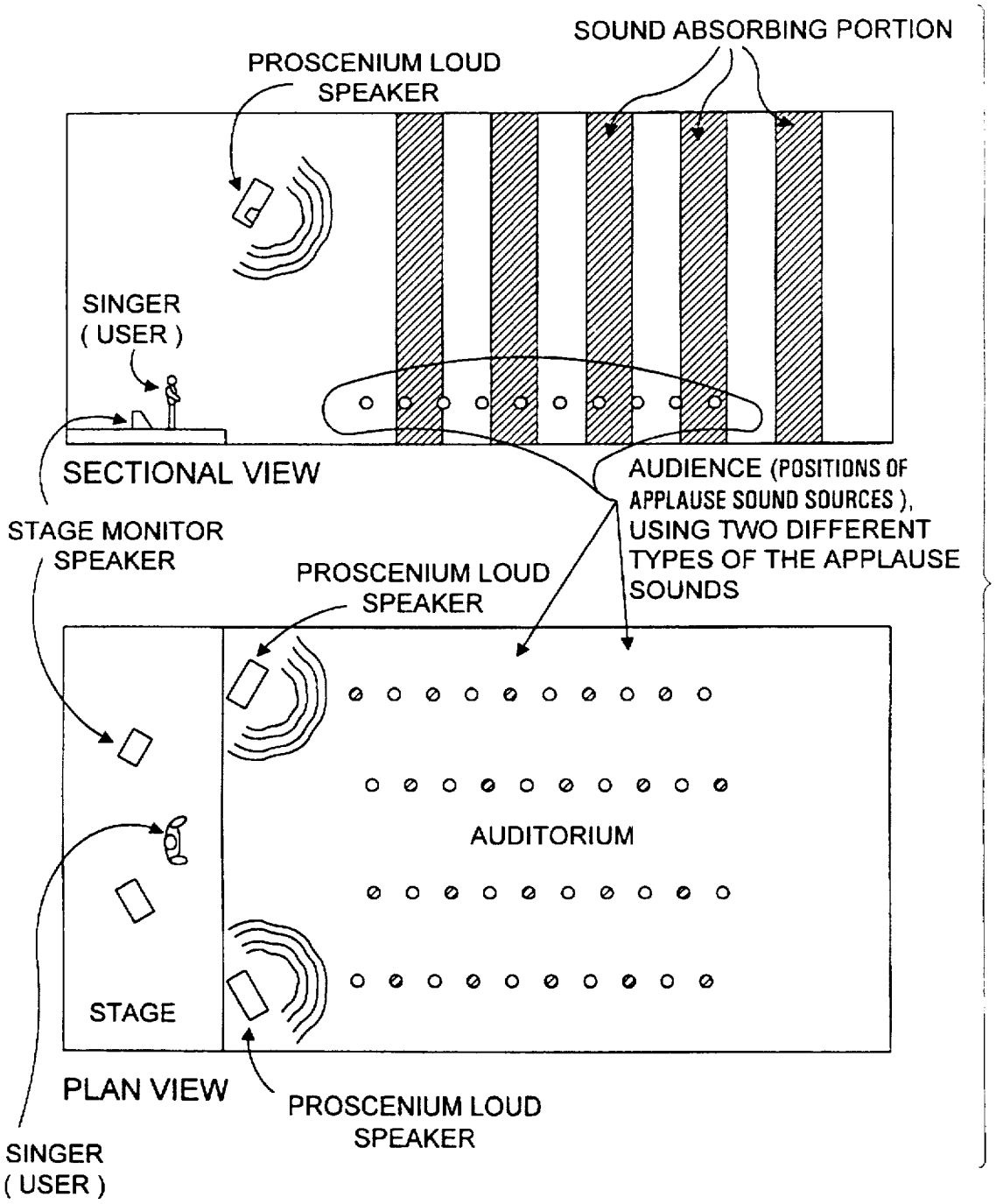
FIG. 23 is a schematic view of a virtual concert hall, illustrating the relationship between a singer and the remaining sound sources both illustrated in side and planned views.

In the embodiment of the present invention, as shown in FIG. 23, a simple shoe-box type virtual concert hall is used, the hall having a width of 16 m, a height of 13 m and a depth of 25 m. Loud speakers disposed in the virtual space comprised of proscenium loud speakers disposed in an upper portion of the stage and monitor loud speakers disposed on the stage, each of which loud speakers was provided with a right and a left channel. Each of the loud speakers has carefully considered directional frequency characteristics. The material used for the floor and the wall surfaces of the hall is hard wood. The hall is provided with multiple of acoustic absorption portions for preventing acoustic trouble such as echoing.

The sound source of the applause that was used was actually recorded. The number of positions of the sound source of the applause in the auditorium of the virtual space is forty. Further, for the sound field synthesis apparatus, from an economical point of view, to reduce the number of the channels of the sum-of-products calculator, there were two types of applauses used.

As for the number of channels (i.e., the number of filters) of the apparatus carrying out convolution transform calculus (hereinafter referred to as the convolution-transform apparatus), the lower the number, the lower the manufacturing cost. Consequently, it is preferable to reduce the number of types of sound that will be radiated in the virtual space. In the case that the sound field is synthetically produced using 4 loud speakers, as it is in the embodiment of the present invention, four channels need to be processed by the convolution-transform apparatus for a single sound source.

The sound sources installed in the virtual space in the embodiment of the present invention are as follows:

(1) the right channel on the proscenium loud speaker;

(2) the left channel on the proscenium loud speaker;

(3) the right channel on the stage monitor loud speaker;

(4) the left channel on the stage monitor loud speaker;

(5) twenty sound sources type 1 for producing the applause in the auditorium; and (6) twenty sound sources type 2 for producing the applause in the auditorium.

As a result, the total number of the sound sources calculated for the sound simulation is forty-four. Consequently, the number of the sound sources to be calculated for the sound simulation is forty-four. On the other hand, the total number of types of sound is only four, two of which are the right and left channel of Karaoke music mixed with the user's singing voice, and the remaining two of which are the applause.

As for each of the 4 transient responses calculated using a sound source comprising of the right channel of the proscenium loud speaker and the right channel of the stage monitor loud speaker, since an audio signal prepared by mixing sound of the right channel of a stereo player and the like with the user's singing voice, is calculated by the use of convolution transform calculus, the 4 transient responses are summed up in each of the directions in which the sound reaches the user.

As for the 4 transient responses calculated using the sound source comprising of the left channel of the proscenium loud speaker and the left channel of the stage monitor loud speaker, the same calculation as the above is carried out. As a result, the total number of transient responses of Karaoke music and the user's singing voice is eight.

On the other hand, the transient response is calculated in the forty positions of the sound sources of the applause. For the same reason as that described above, forty-four transient responses are obtained by using sound sources disposed in twenty positions, and are summed up in each of the directions in which the applause reaches the user. As a result, the total number of transient responses of the applause is eight.

Therefore, the number of the channels of the convolution-transform apparatus is sixteen. This is because a transient response is required in each of four directions for a single sound source. Incidentally, even when Karaoke music is monaural, it is preferable to process it in the same manner as that described above.

Figure 24:
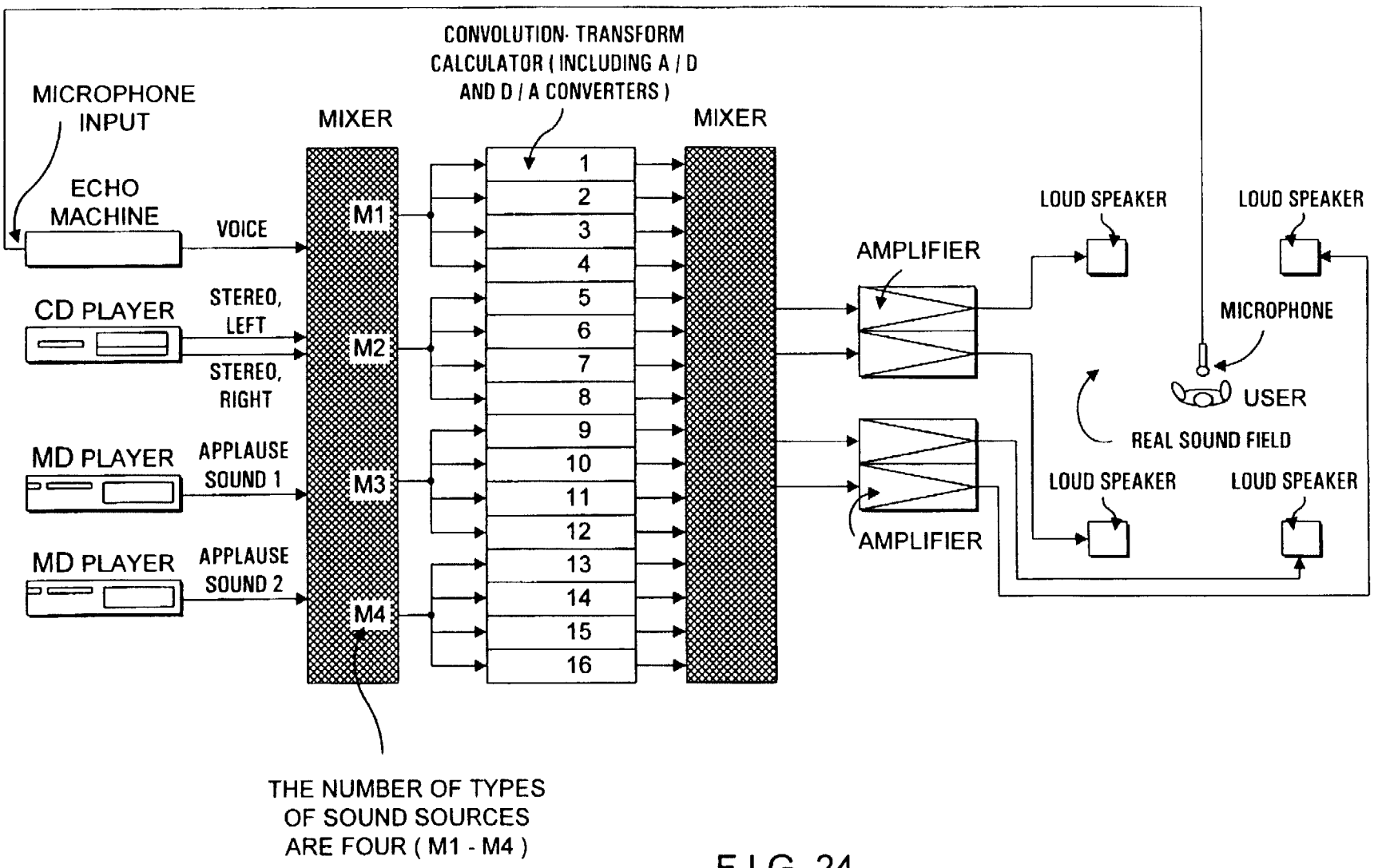
FIG. 24 is a schematic block diagram of a sound-field synthesis apparatus for enjoying so-called virtual reality Karaoke.

Shown in FIG. 24 is a schematic block diagram of the sound-field synthesis apparatus used in the embodiment of the present invention. The sum-of-products calculator show in FIG. 24 comprises of a digital-to-analog converter (D/A converter) and an analog-to-digital converter (A/D converter). Incidentally, the number of loud speakers used in the synthesis apparatus is eight. In the case that a transient response is calculated in each of eight directions for each of the sound sources, since the number of types of the sound sources to be calculated by the use of the sum-of-products calculator is four, it is necessary to provide thirty-two (i.e., $4\times8=32$) channels in the convolution transform apparatus.

As described above for the embodiment of the present invention, in order to reduce the manufacturing cost by reducing the number of convolution-transform channels of the sum-of-products calculator, it is necessary to lower the number of types of the sound sources.

The above system shown in the embodiment of the present invention was applied to Karaoke. As a result, users of Karaoke enjoyed acoustic realism, (which conventional Karaoke systems have never realized) as though he/she were on a real stage. Further, in the case that a user played a musical instrument, he/she enjoyed the same acoustic realism as above.

Although the present invention has been described using an application of the invention to a Karaoke system above, the present invention is also applicable to any other systems described above.

EFFECT OF THE INVENTION

It is possible with the present invention to analyze acoustic characteristics of sound and systems within a very short period of time without using a large-scale computer, which makes it possible to apply simulation of sound with its wave characteristics for practical use.

Figure 25A:
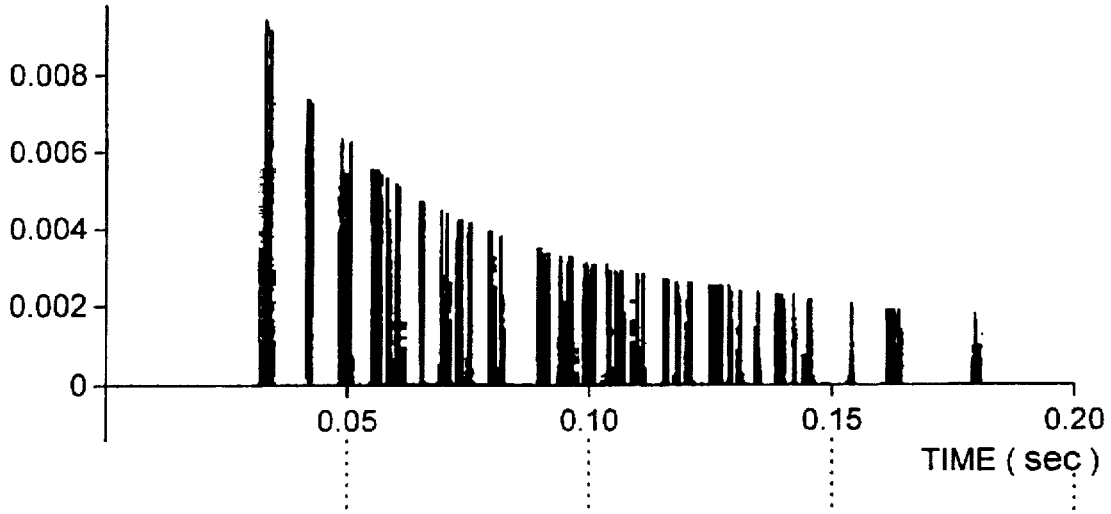
FIG. 25(A) is a graph of the response obtained by the use of conventional orthodox calculation method called the virtual-image method.
Figure 25B:
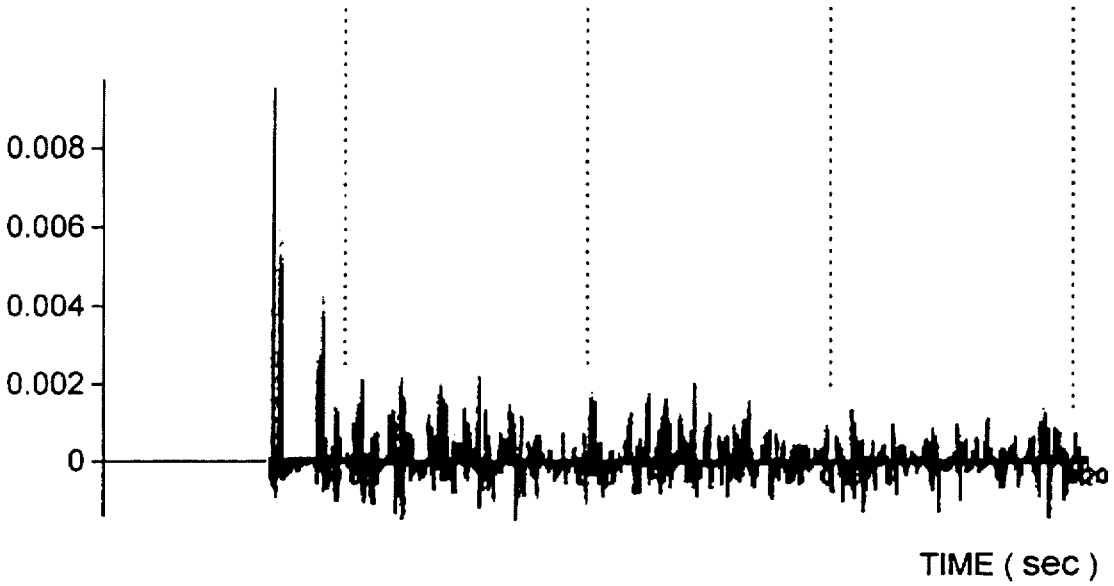
FIG. 25(B) is a graph of the impulse response obtained in the virtual space by the use of the calculating procedure of the present invention.

Shown in FIG. 25(A) is an example of a transient response of a hall, which was obtained by using the conventional orthodox calculus called the virtual-image method. On the other hand, shown in FIG. 25(B) is an example of an impulse response calculated by using a program prepared according to the present invention. As is clear from these drawings, the orthodox calculus failed to calculate negative waves, and merely showed atmospheric exponential attenuation of energy. On the other hand, in the present invention, it was found that: the impulse response obtained by using the present invention showed boundary waves represented by negative values; phase information was calculated; and, complex attenuation was entirely calculated.

In the program based on the processing procedure of the present invention, it was possible to accomplish all the necessary calculation of the program within a very short period of time with the use of a small-scale computer. In contrast with this, the conventional calculus method required tens of thousands of hours in calculation of the impulse response with audio frequency band even when a high-speed computer such as super computers and the like were used, and, was therefore not applicable to practical use. The present invention enables the sound to be synthetically produced and also to be reproduced for practical use. Since the present invention is capable of simulating propagation of sound with its wave characteristics, it is possible for the present invention to enable users to enjoy acoustic realism with higher accuracy in any arbitrary space. More specifically, the present invention provides a fundamental technique for the following application: namely, architecture the present invention enables users to calculate and evaluate various physical-quantity data comprising acoustic characteristics of a building such as concert halls, studios, listening rooms and the like before the building is constructed.

Further, the present invention enables users to simulate desired sound fields of the interior of aircraft and vehicles, and also to perform various types of other simulation with reality. Still further, the present invention provides other fundamental techniques of simulation, which enables users of the present invention to research propagation of noise produced in air ports, railways, roads, factories and like installations, and make an accurate estimate of noise influence upon cities, buildings, the interiors thereof and the like.

Further, the present invention provides virtual sound reproduction apparatus for synthetically producing three-dimensional virtual sound field in an actual or real space, virtual sound field being substantially the same as that of an actual concert hall and like installations and enabling users of the present invention to enjoy virtual reality in real space as if he or she is actually on the stage of a famous concert hall and the like. Consequently, the present invention is applicable to: Karaoke systems; practical apparatuses for musical instruments, songs, dances and the like; and, like acoustic virtual reality systems. As is clear from the above, the present invention is applicable to musical education and may considerably improve it in quality.

What is claimed is:

1. A method for reproducing three-dimensional virtual space sound, wherein the wave of a sound, which is generated by a sound source at an arbitrary location in a three-dimensional virtual space that is defined by a plurality of arbitrarily set boundaries, is radiated to reproduce acoustics that affect a predetermined observation point, said method comprising the steps of:

representing a transient signal of said sound generated by said sound source by using a plurality of sound ray vectors that extend into said virtual space;

calculating a position on said boundaries at which each of said sound ray vectors that have advanced into said virtual space is reflected; and calculating a velocity potential at which said transient signal at the reflection position reaches said observation point.

2. The method for reproducing three-dimensional virtual space sound according to claim 1, wherein said velocity potential is acquired by using a micro-area, which is defined by the sound ray vector at said reflection position and said transient signal at said reflection position.

3. The method for reproducing three-dimensional virtual space according to claim 1, wherein a distance between adjacent sound ray vectors, which have advanced linearly following the elapse of a predetermined period of time, is equal to or less than ½ a wavelength of reproduced sound.

4. The method for reproducing three dimensional virtual space sound according to claim 1, wherein said velocity potential is represented as:

$$\phi_p = \frac{1}{d} f\left[t - \frac{d}{C}\right] + \frac{1}{4\pi}\int_{S_2}\left[\frac{1}{Crr_o}\frac{\partial}{\partial t} f\left[t - \frac{r_o}{C}\right][\cos(\vec{r},\vec{n}) - \cos(\vec{r_o},\vec{n})] + \frac{1}{rr_o} f\left[t - \frac{r_o}{C}\right]\left[\frac{1}{r}\cos(\vec{r},\vec{n}) - \frac{1}{r_o}\cos(\vec{r_o},\vec{n})\right]\right] dS_2$$

wherein:

$\phi p$ represents the velocity potential at said observation point;

d represents propagation distance;

f(t) represents the transient signal for a sound generated by said sound source;

C represents the speed of sound;

t represents time;

$S_2$ represents the micro-area of the boundary surface of said virtual space;

r represents the distance from said reflection position on said boundary surface to said observation point;

$r_o$ represents the total propagation distance from said sound source to said reflection position on said boundary surface; and n represents a normal vector on said boundary surface.

5. The method for reproducing three-dimensional virtual space sound according to claim 1, further comprising a step of acquiring a transient response signal by said velocity potential being added to a time-series numerical array and that corresponds to a delay time at which said transient signal reaches said observation point.

6. The method for reproducing three-dimensional virtual space sound according to claim 1, further comprising the steps of:

establishing a real space wherein a plurality of loudspeakers are arranged in order to reproduce in said real space a sound produced in said virtual space;

overlapping said real space and said virtual space to align a listening point in said real space and said observation point in said virtual space;

dividing said velocity potential that is directed toward said observation point into said plurality of loudspeakers that individually are directed toward said observation point; and adding the resultant velocity potentials to an array that is prepared for each of said loudspeakers and that corresponds to said delay time, at which said transient signal reaches said observation point, to acquire a transient response signal for each of said loudspeakers.

7. The method for reproducing three-dimensional virtual space sound according to claim 6, further comprising a step of employing said transient response signal for each of said loudspeakers to reproduce a sound generated by said sound source at a convolution processor.

8. The method for reproducing three-dimensional virtual space sound according to claim 1, further comprising the steps of:

forming, inside said virtual space, a closed space surrounding said observation point or a wall surface facing said observation point, and dividing said closed space or said wall surface to provide a plurality of virtual windows;

specifying a virtual window through which said velocity potential passes; and adding said velocity potential to a numerical array that is prepared for each of said virtual windows and that corresponds to said delay time, at which said transient signal reaches said observation point, to acquire a transient response signal for each of said virtual windows.

9. The method for reproducing three-dimensional virtual space sound according to claim 8, further comprising the steps of:

locating loudspeakers at positions corresponding to said virtual windows; and employing said transient response signal obtained for each of said virtual windows to reproduce a sound generated by said sound source at a convolution processor.

10. An apparatus for reproducing a three-dimensional virtual space sound, wherein the wave of a sound, which is generated by a sound source at an arbitrary location in a three-dimensional virtual space that is defined by a plurality of arbitrarily set boundaries, is radiated to reproduce acoustics that affect a predetermined observation point, said apparatus comprising:

processing means for defining boundaries to form said virtual space, for representing a transient signal of said sound generated by said sound source by using a plurality of sound ray vectors, for acquiring propagation history data, each time said sound ray vectors are reflected at said boundaries and advance, that include positions at which said sound ray vectors are reflected, and for employing said propagation history data to calculate a velocity potential when a transient signal from each of the reflection positions reaches said observation point; and storage means for storing said propagation history data.

11. The apparatus for reproducing a three-dimensional virtual space sound according to claim 10, wherein said velocity potential is acquired by using a micro-area, which is defined by the sound ray vector at each of said reflection positions and said transient signal at each of said reflection positions.

12. The apparatus for reproducing a three dimensional virtual space sound according to claim 10, wherein a distance between adjacent sound ray vectors, which have advanced linearly following the elapse of a predetermined period of time, is equal to or less than ½ a wavelength of a reproduced sound.

13. The apparatus for reproducing a three-dimensional virtual space sound according to claim 10, wherein said velocity potential is represented as:

$$\phi_p = \frac{1}{d} f\left[t - \frac{d}{C}\right] + \frac{1}{4\pi}\int_{S_2}\left[\frac{1}{Crr_o}\frac{\partial}{\partial t} f\left[t - \frac{r_o}{C}\right][\cos(\vec{r}, \vec{n}) - \cos(\vec{r_o}, \vec{n})] + \frac{1}{rr_o} f\left[t - \frac{r_o}{C}\right]\left[\frac{1}{r}\cos(\vec{r}, \vec{n}) - \frac{1}{r_o}\cos(\vec{r_o}, \vec{n})\right]\right] dS_2$$

wherein:

$\phi p$ represents the velocity potential at said observation point;

d represents propagation distance;

f(t) represents the transient signal for a sound generated by said sound source;

C represents the speed of sound;

t represents time;

$S_2$ represents the micro-area of the boundary surface of said virtual space;

r represents the distance from said reflection position on said boundary surface to said observation point;

$r_o$ represents the total propagation distance from said sound source to said reflection position on said boundary surface; and n represents a normal vector on said boundary surface.

14. The apparatus for reproducing a three-dimensional virtual space sound according to claim 10, wherein said processing means acquiring a transient response signal by said velocity potential being added to a time-series numerical array and that corresponds to a delay time at which said transient signal reaches said observation point.

15. The apparatus for reproducing a three-dimensional virtual space sound according to claim 10, further comprising a plurality of loudspeakers arranged in order to reproduce in a real space a sound produced in said virtual space, said processing means overlapping said real space and said virtual space to align a listening point in said real space and said observation point in said virtual space, and dividing said velocity potential that is directed toward said observation point into said plurality of loudspeakers that individually are directed toward said observation point, and adding the resultant velocity potentials to an array that is prepared for each of said loudspeakers and that corresponds to said delay time, at which said transient signal reaches said observation point, to acquire a transient response signal for each of said loudspeakers.

16. The apparatus for reproducing a three-dimensional virtual space sound according to claim 15, further comprising a convolution processor to reproduce a sound generated by said sound source by employing said transient response signal for each of said loudspeakers.

17. The apparatus for reproducing a three-dimensional virtual space sound according to claim 10, wherein said processing mean forms, inside said virtual space, a closed space surrounding said observation point or a wall surface facing said observation point, and dividing said closed space or said wall surface to provide a plurality of virtual windows, specifying a virtual window through which said velocity potential passes, and adding said velocity potential to a numerical array that is prepared for each of said virtual windows and that corresponds to said delay time, at which said transient signal reaches said observation point, to acquire a transient response signal for each of said virtual windows.

18. The apparatus for reproducing a three-dimensional virtual space sound according to claim 17, further comprising:

loudspeakers located at positions corresponding to said virtual windows; and a convolution processor to reproduce a sound generated by said sound source by employing said transient response signal obtained for each of said virtual windows.

* * * * *